US011713169B2

(12) United States Patent
Vachon

(10) Patent No.: US 11,713,169 B2
(45) Date of Patent: Aug. 1, 2023

(54) VENTED SPOUT FOR A LIQUID STORAGE CONTAINER

(71) Applicant: LE GROUPE DSD INC., Thetford Mines (CA)

(72) Inventor: Leandre Vachon, Thetford Mines (CA)

(73) Assignee: LE GROUPE DSD INC., Thetford Mines (CA)

( * ) Notice: Subject to any disclaimer, the term of this patent is extended or adjusted under 35 U.S.C. 154(b) by 235 days.

(21) Appl. No.: 17/348,290

(22) Filed: Jun. 15, 2021

(65) Prior Publication Data

US 2021/0309424 A1 Oct. 7, 2021

Related U.S. Application Data

(63) Continuation of application No. PCT/CA2019/051897, filed on Dec. 20, 2019.

(30) Foreign Application Priority Data

Dec. 21, 2018 (CA) ..... CA 3028492

(51) Int. Cl.
*B65D 47/20* (2006.01)
*B65D 25/48* (2006.01)
(Continued)

(52) U.S. Cl.
CPC ..... *B65D 47/2062* (2013.01); *B65D 25/48* (2013.01); *B65D 47/32* (2013.01);
(Continued)

(58) Field of Classification Search
CPC .... B65D 47/2062; B65D 47/32; B65D 25/48; B65D 50/06; B65D 51/16; B65D 2215/04; B65D 47/248; B65D 47/06
(Continued)

(56) References Cited

U.S. PATENT DOCUMENTS 886,237 A 4/1908 Murtha
2,723,793 A 11/1955 Hubbell
(Continued)

FOREIGN PATENT DOCUMENTS

CA 2545907 A1 11/2007
CA 2546129 A1 11/2007
(Continued)

OTHER PUBLICATIONS

Examination Report Issued in parent Indian Application No. 202117032250, dated Jan. 27, 2023.
(Continued)

*Primary Examiner* — Lien M Ngo
(74) *Attorney, Agent, or Firm* — Lavery, De Billy, LLP; Gwendoline Bruneau

(57) ABSTRACT

The vented pouring spout includes a main body and a valve system movable between a normally closed position and a fully opened position. The main body includes a first member and a second member. The valve system includes a valve member and two spaced-apart and parallel stems projecting from an inner side of the valve member into the first member. A push button is mounted within a housing and is in an axial force-transmitting engagement with the stems. The spout, among other things, can include a child-resistant closure (CRC) device that can be operated using a single finger, for instance the thumb or any other finger, and while holding a small container.

20 Claims, 23 Drawing Sheets

(51) Int. Cl.
*B65D 47/32* (2006.01)
*B65D 50/06* (2006.01)
*B65D 51/16* (2006.01)

(52) U.S. Cl.
CPC ..... *B65D 50/06* (2013.01); *B65D 51/16* (2013.01); *B65D 2215/04* (2013.01)

(58) Field of Classification Search
USPC .... 222/481, 481.5, 484, 483, 511, 518, 522, 222/559, 547, 566
See application file for complete search history.

(56) References Cited

U.S. PATENT DOCUMENTS 2,822,832 A 2/1958 Craw
2,841,313 A 7/1958 Beall, Jr.
3,074,444 A 1/1963 Hawksford
3,434,513 A 3/1969 O'Bannon
3,540,402 A 11/1970 Kocher
3,606,096 A 9/1971 Campbell
3,734,149 A 5/1973 Hansel
3,834,594 A 9/1974 Schiemann
3,967,660 A 7/1976 Russell
3,987,943 A 10/1976 Richmond, Jr.
3,994,323 A 11/1976 Takahata et al.
4,053,002 A 10/1977 Ludlow
4,129,236 A 12/1978 Wrycraft et al.
4,213,488 A 7/1980 Pyle
4,478,242 A 10/1984 Bond
4,564,132 A 1/1986 Lloyd-Davies
4,667,710 A 5/1987 Wu
4,687,122 A * 8/1987 Bothun ..... B67D 3/044 222/484
4,746,036 A 5/1988 Messner
4,796,678 A 1/1989 Motohashi et al.
D303,634 S 9/1989 Vachon
4,871,096 A 10/1989 Horian
4,924,921 A 5/1990 Simmel et al.
4,958,668 A 9/1990 Vachon
4,982,881 A 1/1991 Amrein
5,042,698 A 8/1991 Fessell
5,076,333 A 12/1991 Law
5,092,497 A 3/1992 Toedter
5,107,909 A 4/1992 Donovan
5,228,487 A 7/1993 Thiermann et al.
5,249,611 A 10/1993 Law
5,255,713 A 10/1993 Scholle et al.
5,327,945 A 7/1994 Simpson et al.
5,406,994 A 4/1995 Mitchell et al.
5,419,378 A 5/1995 Law
5,450,884 A 9/1995 Shih et al.
5,507,328 A 4/1996 Donovan
5,560,522 A 10/1996 Clark
5,603,364 A 2/1997 Kerssies
5,628,352 A 5/1997 Gracyalny et al.
5,711,355 A 1/1998 Kowalczyk
5,762,117 A 6/1998 Law
5,961,001 A 10/1999 Davis et al.
5,988,458 A 11/1999 Messner
6,155,464 A 12/2000 Vachon
6,227,419 B1 5/2001 Raboin
6,401,752 B1 * 6/2002 Blackbourn ..... B67D 3/044 137/589
6,435,380 B1 8/2002 Raboin
6,478,058 B1 11/2002 Pears
6,581,851 B1 6/2003 Murphy
6,722,535 B1 4/2004 Flach
6,742,680 B2 6/2004 Friedman
6,889,732 B2 5/2005 Allen
6,968,875 B2 11/2005 Nielsen
7,013,936 B2 3/2006 Schliemann et al.
7,513,395 B2 4/2009 Labinski et al.
7,543,723 B2 6/2009 Wilford et al.
7,621,304 B2 11/2009 Nielsen
8,038,035 B2 10/2011 Forbis
8,113,239 B2 2/2012 Richards et al.
8,201,595 B2 6/2012 Trippi, Jr.
8,403,185 B2 3/2013 Vachon
8,567,646 B1 10/2013 Cray
8,616,419 B2 12/2013 Slack
8,800,826 B2 8/2014 Forbis et al.
9,493,280 B2 11/2016 Wilkinson et al.
9,783,404 B2 10/2017 Van Gelder et al.
10,196,187 B2 2/2019 Hingorani
10,308,405 B2 6/2019 Gaikwad et al.
10,427,843 B2 10/2019 Julien et al.
10,472,137 B2 11/2019 Vachon
10,683,148 B2 6/2020 Adam et al.
11,286,153 B1 * 3/2022 Kieras ..... B67D 3/046
11,332,358 B2 * 5/2022 Darby ..... B67D 3/044
2009/0090745 A1 * 4/2009 Forbis ..... B65D 47/249 222/509
2012/0118431 A1 5/2012 Dickie
2014/0097210 A1 4/2014 Wright
2015/0291410 A1 * 10/2015 Eriksson ..... B65D 43/0204 222/189.09
2017/0327281 A1 11/2017 Cross
2019/0093823 A1 3/2019 Scott et al.

FOREIGN PATENT DOCUMENTS

CN 203558842 U 4/2014
EP 0112938 A2 7/1984
EP 3067312 B1 8/2017
JP 11070957 A 3/1999
JP 2005041541 A 2/2005
WO 2015052507 A1 4/2015
WO 2019200469 A1 10/2019
WO 2020124272 A1 6/2020
WO 2020154792 A1 8/2020

OTHER PUBLICATIONS

Machine translation in English of CN203558842.
Machine translation in English of JP11070957.
Machine translation in English of JP2005041541.
Machine translation in English of EP3067312B1.

* cited by examiner

VENTED SPOUT FOR A LIQUID STORAGE CONTAINER

CROSS REFERENCE TO PRIOR APPLICATIONS

The present case is a continuation of PCT Application No. PCT/CA2019/051897 filed 29 Dec. 2019. PCT/CA2019/051897 claims the benefits of Canadian patent application No. 3,028,492 filed 21 Dec. 2018. The entire contents of these prior patent applications are hereby incorporated by reference.

TECHNICAL FIELD

The technical field relates generally to vented spouts for liquid-storage containers.

BACKGROUND

Many different kinds of spouts have been proposed over the years for use during a gravity transfer of liquids from a container into a receptacle, such receptacle being for instance another container or a tank, to name just a few. Some of these spouts include an air vent to admit air inside the container through the spouts when the liquid flows, and also a shutoff valve to control the liquid flow during the transfer. Examples can be found, for instance, in U.S. Pat. Nos. 8,403,185 and 8,561,858.

While most of the prior arrangements have been generally useful and convenient on different aspects, there are still some limitations and challenges remaining in this technical area for which further improvements would be highly desirable.

SUMMARY

In one aspect, there is provided a vented pouring spout for a liquid-storage container, the spout including: a main body including: a first member and a second member that extends from a side of the first member, the first member having opposite first and second open ends, the first member including a liquid chamber and a housing that are separated by an internal partition inside the first member; a liquid circuit passing inside the liquid chamber and then inside a liquid passageway that extends within the second member, the liquid circuit entering the liquid passageway from the liquid chamber through a side opening of the first member; an air circuit segregated from the liquid circuit and positioned along a top inner side of the main body, the air circuit passing through an air passageway including a first segment, a second segment and a third segment disposed in juxtaposition inside the first member, the first segment being positioned inside the second member, the second segment interconnecting the first and third segments; and a valve system movable between a normally closed position and a fully opened position, the valve system including: a valve member engaging the first open end of the first member in the normally closed position; two spaced-apart and parallel stems projecting from an inner side of the valve member into the first member, each stem extending longitudinally inside the first member and being slidably engaged into a corresponding opening made through the partition, each stem passing on a respective lateral side of the second segment of the air passageway; a push button mounted within the housing and being in an axial force-transmitting engagement with the valve member at least through the stems; and a biasing element located inside the housing to urge the valve member in the normally closed position.

Further details on the different aspects of the proposed concept will be apparent from the following detailed description and the appended figures.

DETAILED DESCRIPTION

Figure 1:
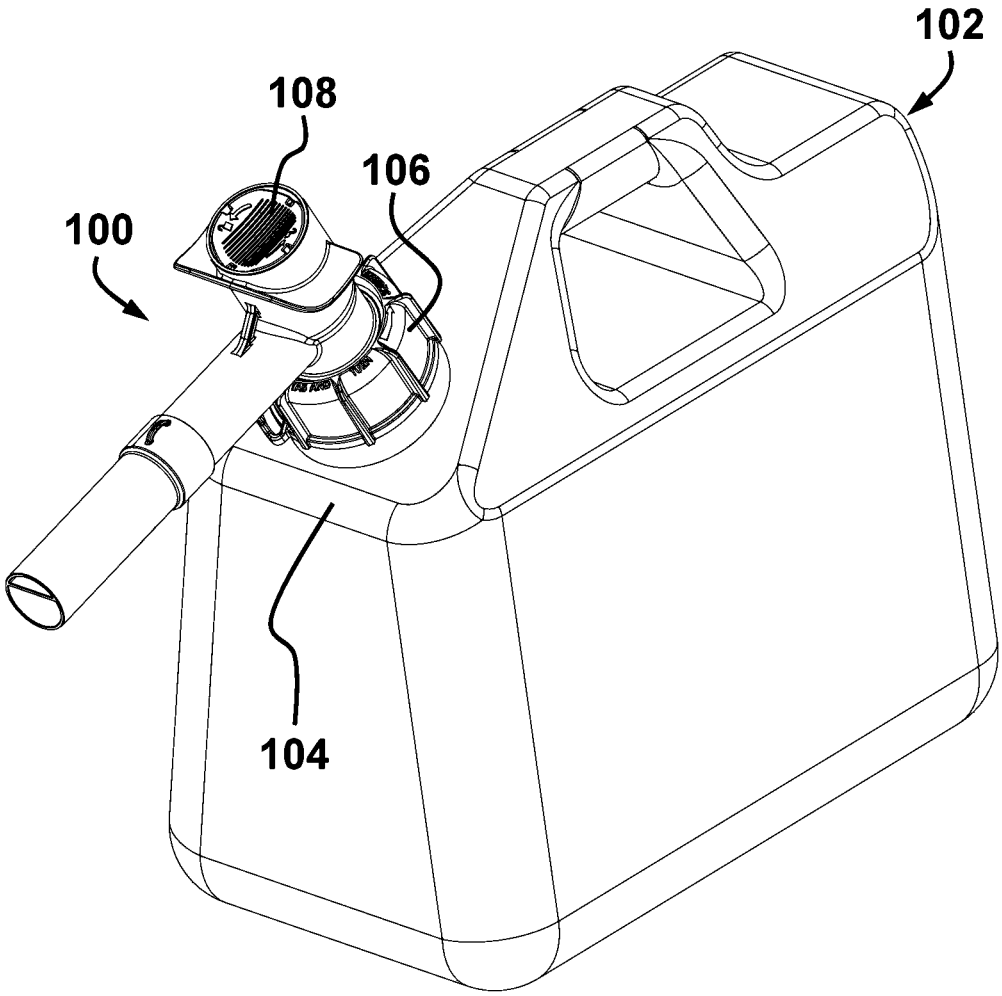
FIG. 1 is a front isometric view illustrating an example of a generic liquid-storage container on which is attached an example of a spout as improved.

FIG. 1 is a front isometric view illustrating an example of a generic liquid-storage container 102 on which is attached an example of a spout 100 as improved. This container 102 can be, for instance, a portable rigid container or canister designed for transporting and storing liquids such as gasoline, diesel or other liquid fuel products. Although the illustrated spout 100 is well adapted for use with hazardous volatile liquids, it can work equally well with liquids that are not fuel or even hazardous products. The container 102 illustrated in FIG. 1 is only an example. The spout 100 can be used with other kinds of liquid-storage containers, including ones that are not rigid, not portable, or both.

In the present description, a container is considered to be rigid when air must enter therein to compensate the volume of liquid being poured. A nonrigid container can be progressively collapsed, at least up to a certain degree, as the liquid is poured whereas for a rigid container such as the illustrated container 102, air must continuously enter during pouring. If not, the flow of liquid out of the container 102 will be severely reduced and can even be interrupted. Although the container 102 illustrated in FIG. 1 has no visible auxiliary air vent opening, many portable containers, such as those commonly available for transporting and storing liquid fuel products, include an auxiliary air vent opening on a top part thereof to release built-in pressure, to admit air when pouring liquids using non-vented spouts, or both. An auxiliary air vent opening is relatively small in size and is generally closed by a corresponding threaded cap or the like. A vented spout such as the illustrated spout 100 alleviates the need of having an auxiliary air vent opening, or having to open it if one is present, since air is admitted through the spout itself. Hence, any auxiliary air vent opening on a container can and should remain completely closed when pouring liquid using the vented spout 100. The spout 100 can still be used even if the auxiliary air vent opening on a given container is partially or fully opened, but the user will then forgo at least some of the benefits of the spout 100. For the sake of simplicity, the rest of the present description will assume that air can only enter the container 102 through the vented spout 100 during pouring.

The spout 100 is shown in FIG. 1 as being secured to a threaded neck portion 104 of the container 102 using a corresponding threaded annular collar 106. The collar 106 can have internal threads matching the external threads on the neck portion 104. The collar 106 can include a central opening through which the spout 100 extends when secured to the container 102, as shown. Other configurations and arrangements are possible. Among other things, at least some of these parts can be designed differently or be omitted. Other variants are possible as well.

The spout 100 includes a built-in shutoff valve system that can be actuated using a push button 108 located at a top end of the spout 100 shown in FIG. 1. This push button 108 is attached inside the spout 100 and cannot be removed in normal use. The spout 100 can also include a child-resistant closure (CRC) device, as shown in the illustrated example. This CRC device can act as a fail-safe childproof security system that keeps the spout 100 locked unless a specific operation is performed to unlock it. The CRC device can automatically reset itself back into the normally locked state when there is no actuation exerted by the user. The push button 108 is part of the CRC device in the illustrated example. Other configurations and arrangements are possible. Among other things, the CRC device can be entirely omitted in some implementations, in which case the push button 108 can simply be used to actuate the valve system of the spout 100. At least some of the parts can also be designed differently or be omitted. Other variants are possible as well.

Figure 2:
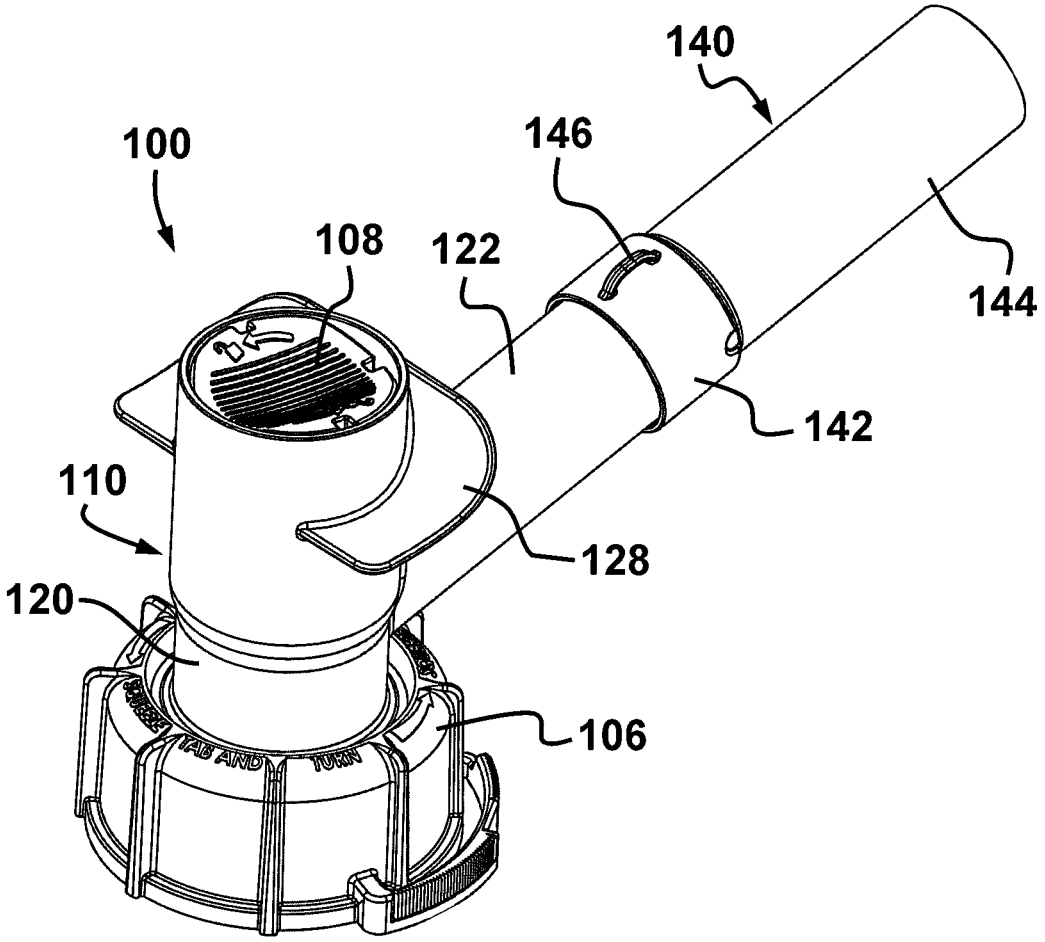
FIG. 2 is a rear isometric view of the spout shown in FIG. 1.
Figure 3:
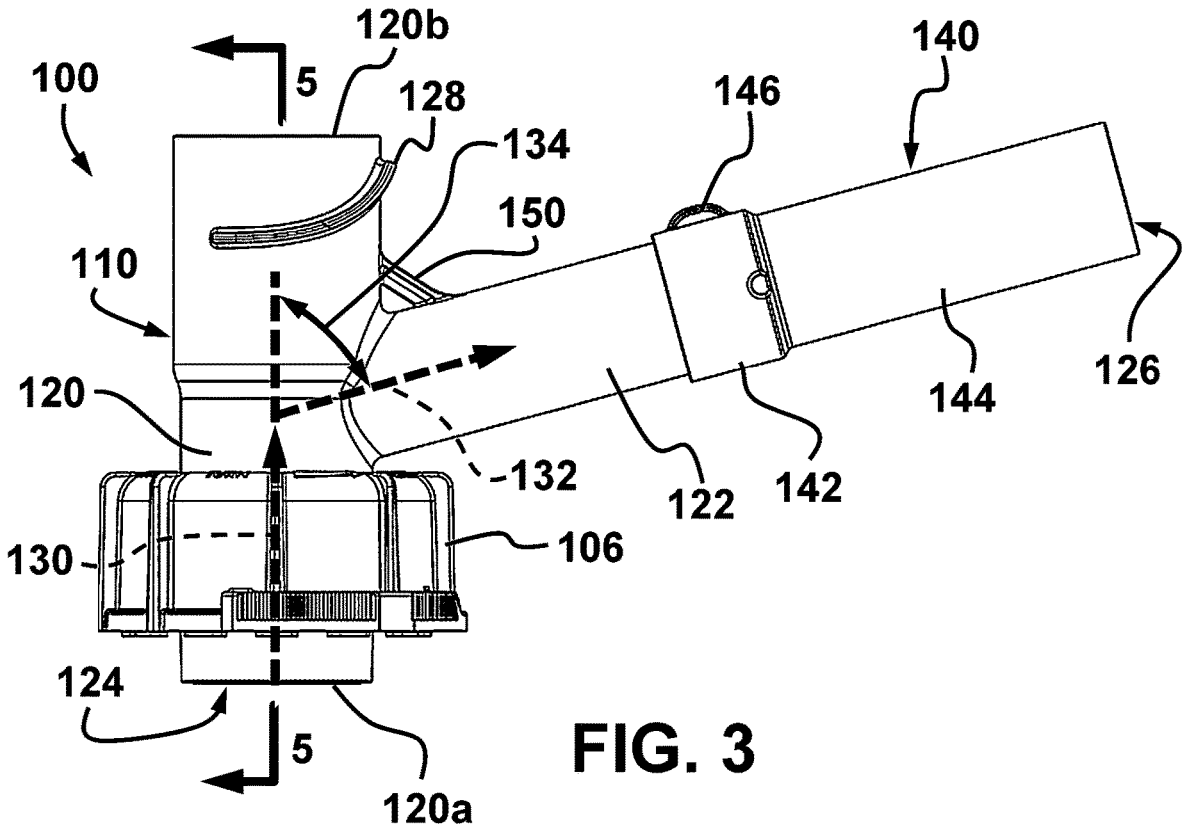
FIG. 3 is a side view of the spout shown in FIG. 1.
Figure 4:
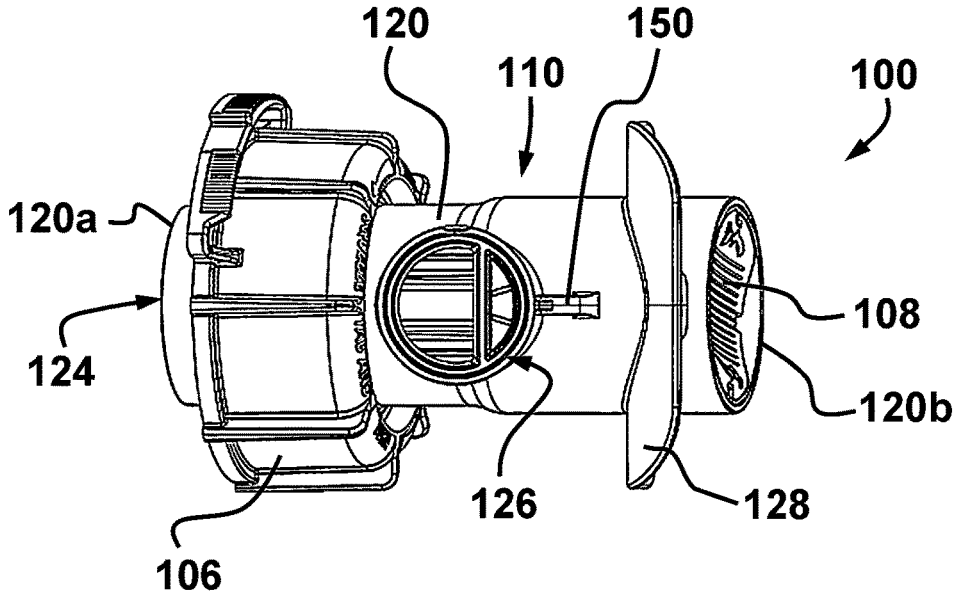
FIG. 4 is a bottom view of the spout shown in FIG. 1.

FIGS. 2 to 4 are, respectively, a rear isometric view, a side view and a bottom view of the spout 100 shown in FIG. 1. These figures also show the collar 106 in addition to the spout 100. The spout 100 can be configured for use with a dedicated standard-sized collar 106 permanently set around the spout 100 at some point prior to the time of purchase, as shown in the illustrated example, for instance during its manufacturing. Once in position on the spout 100, the illustrated collar 106 can pivot around the spout 100 and also be axially movable over a small distance along the spout 100. Alternatively, in some implementations, the spout 100 can be sold without a collar 106 and the spout 100 could be used with a collar 106 that is freely removable from it.

Other configurations and arrangements are possible. Among other things, the spout 100 could be made integral with a dedicated container. Other kinds of collars can also be used. The collar 106 can be entirely omitted in some implementations. Other variants are possible as well.

The spout 100 can include a main body 110 that forms the basic outer shell of the spout 100, as shown in the illustrated example. As shown, the main body 110 can include two main parts, namely a first member 120 and a second member 122, that are in fluid communication with one another. The second member 122 can also extend from the side of the first member 120. Both members 120, 122 are made integral with one another in this implementation, for instance as a result of a plastic injection molding or by thermal fusion, to form a monolithic part. Other configurations and arrangements are possible. Among other things, the two members 120, 122 could be removably connected together in some implementations, thereby allowing the user to disconnect them when not in use. The main body 110 can have a completely different construction in some implementations. Still, although the first and second members 120, 122 as well as other parts are generally circular in cross section, both internally and externally, using noncircular shapes remains possible in some implementations. The present description refers to the diameter of some of the parts only for the sake of simplicity and not because they necessarily must have a circular cross section. Other variants are also possible as well.

The spout 100 generally extends between a base 124 and a tip 126, as shown in FIGS. 3 and 4. This spout base 124 is the part of the spout 100 that can be inserted through the neck portion 104 of the container 102 and that can extend therein. It is also where the liquid enters inside the illustrated spout 100 and where the air exits the spout 100 during pouring. The spout tip 126 is where the liquid exits the spout 100 and also where the air enters therein.

The first and second members 120, 122 can be substantially straight conduits having substantially circular cross sections, as shown in the illustrated example. They each extend along a corresponding longitudinal axis 130, 132. These first and second members 120, 122 are positioned so that the longitudinal axes 130, 132 are substantially intersecting at a relative acute angle depicted in FIG. 3 at 134. The acute angle 134 represents, among other things, the deviation in the general direction of the liquid flowing inside the spout 100 during pouring between the first and second members 120, 122. The acute angle 134 is approximately 75 degrees in this example. However, the exact angle can vary, for instance of plus or minus 10 degrees. This overall arrangement was found to be optimal for many implementations, such as for pouring liquid fuel products from relatively small containers. It can also make it easier to view the liquid level in the receptacle into which the liquid is poured. Nevertheless, other angles, configurations and arrangements are possible. Among other things, at least some of these parts can be designed differently or be omitted. Other variants are possible as well.

Figure 14:
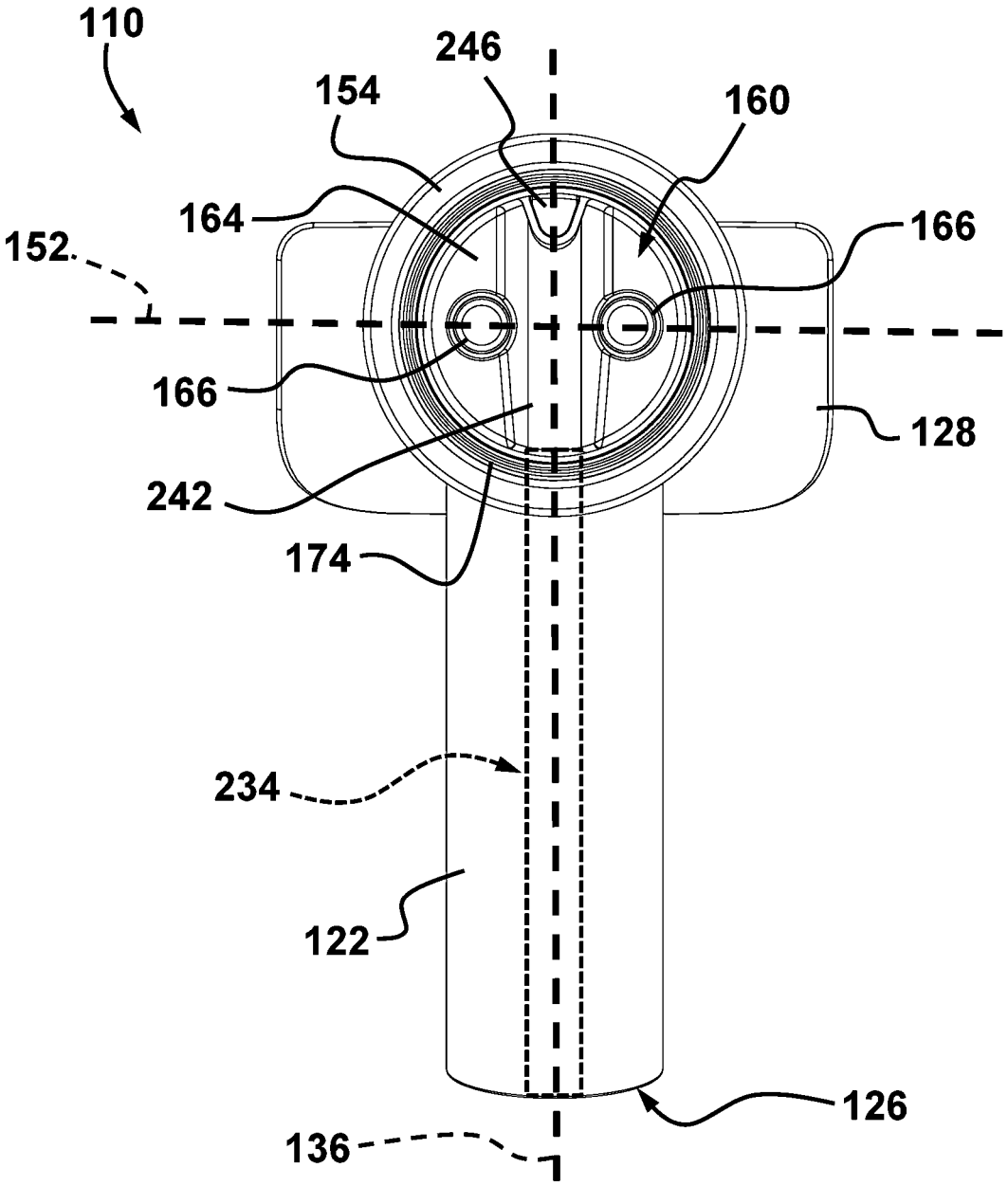
FIG. 14 is a front view of only the main body of the spout shown in FIG. 1.

The two longitudinal axes 130, 132 of the members 120, 122 in the illustrated example also define a two-dimensional geometric medial plane passing through the entire spout 100 and dividing it in two substantially symmetrical halves. In most situations, this medial plane will be vertically oriented or be very close to the vertical when pouring liquids through the spout 100. The medial plane is schematically depicted in FIG. 14 at 136. Other configurations and arrangements are possible.

The first member 120 can have two opposite open ends 120*a*, 120*b*, as shown in FIG. 4. This first open end 120*a* is located at the spout base 124. The push button 108 can be located next to the second open end 120*b* when the spout 100 is in its normally closed position, as shown. Still, a relatively large finger-gripping protrusion 128 can be provided on the main body 110, as shown in the illustrated example. This flap-like protrusion 128 can be attached to the outer surface of the first member 120 near the second open end 120*b*, and it can extend somewhat downward, the bottom side being curved slightly outward. Other configurations and arrangements are possible. Among other things, at least some of these parts, for instance the protrusion 128, can be designed differently or be omitted. Other variants are also possible as well.

The spout 100 can further include an extension conduit 140 removably attached at the end of the second member 122, as shown in the illustrated example. The extension conduit 140 can be useful in many circumstances, for instance when pouring liquids into the fuel tank of an automobile having the fuel door located on the side of the vehicle, or for pouring liquids at other locations where there is no or only a very limited space above the receptacle to tilt the container 102. The length of the second member 122 is nearly doubled with the illustrated extension conduit 140. Other configurations and arrangements are possible. Among other things, the extension conduit 140 can be entirely omitted in some implementations. Other variants are possible as well. It should be noted that the spout tip 126 can be considered to be at the free end of the extension conduit 140 when one is attached to the second member 122, as shown in the illustrated example. Otherwise, the spout tip 126 would be the free end of the second member 122.

As shown in the illustrated example, the extension conduit 140 can be coaxially disposed with reference to the second member 122 and be removably attached to the second member 122 using an interference fit, namely that the outer surface at the free end of the second member 122 can be press fitted by hand into a socket portion 142 provided at the proximal end of the extension conduit 140. The illustrated extension conduit 140 also includes a substantially rectilinear elongated portion 144 extending from the socket portion 142. Other configurations and arrangements are possible. Among other things, at least some of these parts can be designed differently or be omitted. Other variants are possible as well.

A hook 146, for instance a closed hook, can be provided on the socket portion 142 of the extension conduit 140, as shown in the illustrated example. The hook 146 can be useful to attach the extension conduit 140 to the rest of the spout 100 prior to the time of purchase. The spout 100 can also further include a reinforcing brace 150 extending between the two members 120, 122 outside the main body 110, as shown. This brace 150 can create a small aperture that can be used to attach the hook 146 to the main body 110 using a tie wrap or any other suitable fastener. Other configurations and arrangements are possible. Among other things, the hook 146 or the brace 150, or even both, can be entirely omitted in some implementations. The socket portion 142 can be provided at the free end of the second member 122 to receive the extension conduit 140. Other variants are possible as well.

Figure 5:
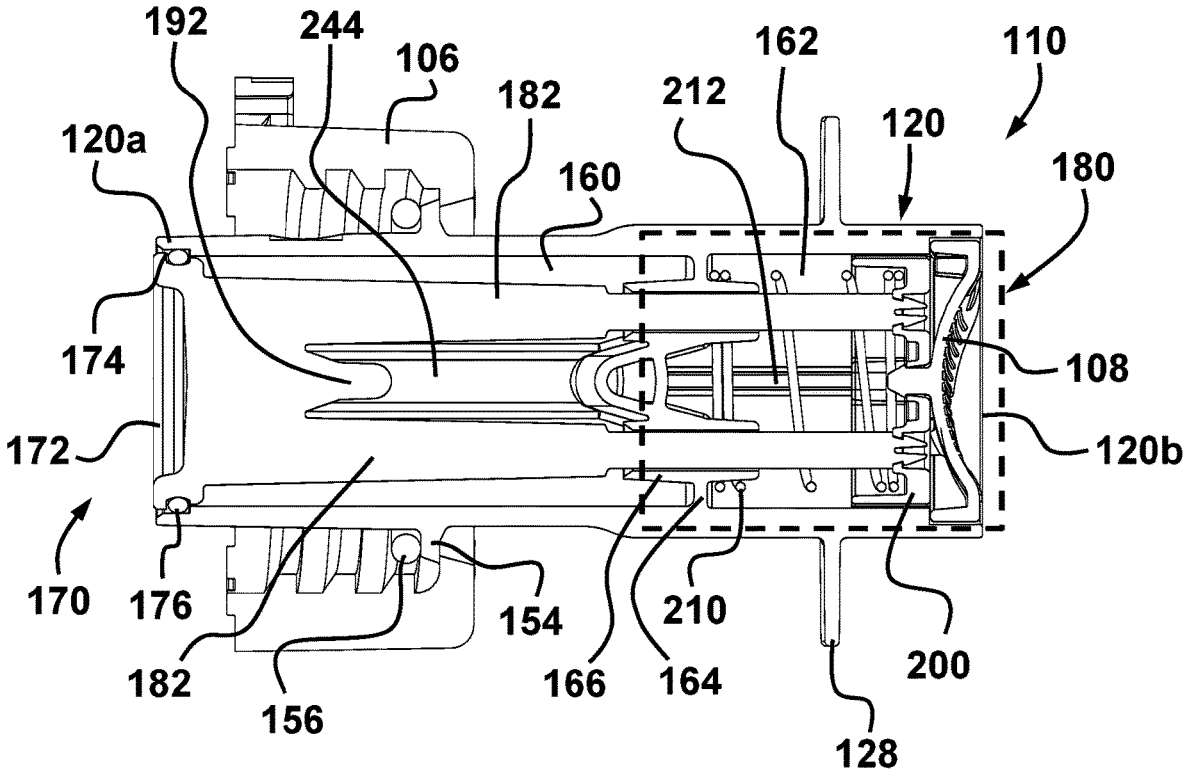
FIG. 5 is a lateral cross section view taken along line 5-5 in FIG. 3.

FIG. 5 is a lateral cross section view taken along line 5-5 in FIG. 3. FIG. 5 illustrates many details of the parts located inside the main body 110 of the spout 100 shown in FIG. 1.

It should be noted that a lateral cross section is, in the context of the present description, a cross section along an imaginary plane that is perpendicular to the medial plane 136 (FIG. 14) and that is also parallel to the longitudinal axis of the corresponding section, namely the longitudinal axis 130 of the first member 120 for the view shown in FIG. 5. The lateral plane is schematically depicted in FIG. 14 at 152.

The base 124 of the spout 100 can have a generally circular shape and be designed to fit inside the neck portion 104 up to an outer rim portion 154, as shown in the illustrated example. This base 124 can be made just large enough to engage the front edge of the neck portion 104. The interior rim around the opening of the collar 106 can engage the opposite side of the outer rim portion 154 and the collar 106 can then be tightened on the neck portion 104 until the spout 100 is solidly secured and the junction between the spout 100 and the neck portion 104 is sealed. As shown in FIG. 5, an outer gasket 156 can be provided under the outer rim portion 154 to enhance the sealing engagement. Other configurations and arrangements are possible. Among other things, the outer gasket 156 can be entirely omitted in some implementations, for instance if the material and the configuration of the parts already provide a suitable sealing engagement for the intended use. Other variants are possible as well.

The first member 120 can include two main sections, one being referred to hereafter as a liquid chamber 160 and the other as a housing 162. This liquid chamber 160 can then constitute the wet side of the first member 120 while the housing 162 can constitute the dry side thereof. These sections can be separated by an internal partition 164 radially extending inside the first member 120. This partition 164, however, can have two spaced-apart openings 166 passing therethrough, as shown. Other configurations and arrangements are possible. Among other things, the outer diameter of the housing 162 can be smaller compared to that of the liquid chamber 160 in some implementations. The illustrated first member 120 is thus simply one example. Other variants are possible as well.

The valve system of the spout 100 is generally identified at 170. The valve system 170 includes a valve member 172 and the valve member 172 can engage a valve seat 174 when the spout 100 is in the normally closed position, as shown in FIG. 5. The valve seat 174 can be a recessed part of the first open end 120*a* and can surround the first open end 120*a* entirely. The valve seat 174 can then be coaxially disposed and be as wide as possible. This way, the diameter of the valve member 172 can be maximized and this can also maximize the liquid flow during pouring. Nevertheless, other configurations and arrangements are possible. Among other things, the recessed valve seat 174 can be omitted in some implementations. For instance, the valve member 172 could engage the annular outer rim surface of the first open end 120*a* in some implementations. The valve seat 174 could be offset, be relatively smaller, or both, in some implementations. Other variants are possible as well.

The axial position of the valve member 172 along the longitudinal axis 130 can vary by changing the axial position of the push button 108. The valve seat 174 is located at the first open end 120*a* of the first member 120. The valve member 172 can include a valve gasket 176, and this valve member 172 can engage the valve seat 174 through its valve gasket 176, as shown in the illustrated example. The valve member 172 can be coaxially disposed with reference to the first member 120 and its outer diameter can be similar in size to that of the first member 120 so as to maximize the flow when opened, as shown. Other configurations and arrangements are possible. Among other things, at least some of these parts can be designed differently or be omitted. Other variants are possible as well.

The spout 100 can include a CRC device and the illustrated spout 100 includes one that is generally identified at 180. The illustrated CRC device 180 is a safety system that must first be unlocked to open the valve member 172. Once unlocked, the axial position of the push button 108, thus its axial position within the housing 162, can determine the position of the valve member 172 with reference to the valve seat 174. Pushing the push button 108 inward, thus to the left in FIG. 5, will cause the valve member 172 to move to the left as well over the same distance. The push button 108 and the valve member 172 can be in a force-transmitting engagement using, among other things, two spaced-apart elongated valve stems 182, as shown. In the illustrated example, these stems 182 extend longitudinally inside the liquid chamber 160, pass across the partition 164 through the openings 166, and extend longitudinally inside the housing 162 when the valve member 172 is in the normally closed position. The openings 166 can be in the form of elongated sleeves to better support and guide the stems 182, and the sleeves can be longer in the longitudinal direction than the thickness of the partition 164, as shown. These sleeves extend longitudinally from the partition 164. The relatively long distance across the openings 166 due to the sleeves can also improve the sealing between the wet side and the dry side of the first member 120. Other configurations and arrangements are possible. Among other things, at least some of these parts can be designed differently or be omitted. Other variants are possible as well.

Figure 6:
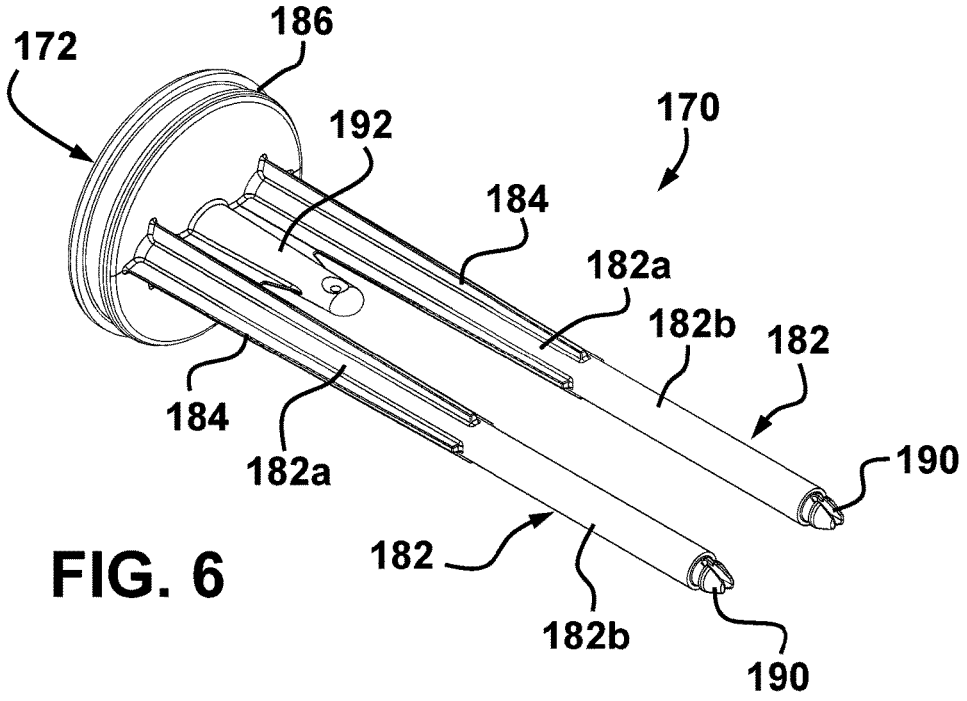
FIG. 6 is a front isometric view of some of the parts of the valve system of the spout shown in FIG. 1.

FIG. 6 is a front isometric view of some of the parts of the valve system 170 of the spout 100 shown in FIG. 1. The same parts can also be seen in FIG. 5. As shown in the illustrated example, the stems 182 can be rectilinear and can project orthogonally from the inner side of the valve member 172. The stems 182 are generally circular in cross section in the illustrated example, but other shapes and configurations are possible. The proximal part 182*a* of each stem 182, namely the one closer to the valve member 172, can include four axisymmetric elongated outer reinforcing ribs 184 running parallel to the stems 182 and decreasing in height towards a distal part 182*b* thereof, as shown. The distal part 182*b* of each stem 182 in the illustrated example has a smooth and regular cylindrical outer surface up to their free end. This distal part 182*b* passes throughout the partition 164 and slidingly engages the inner surface of the corresponding opening 166. The dimensional tolerances between them can be made small enough to substantially prevent liquid from passing from the liquid chamber 160 into the housing 162 but without preventing the stems 182 from sliding inside the openings 166 when the axial position of the valve member 172 is changed. Other configurations and arrangements are possible. Among other things, the cross section of the stems 182 and that of their corresponding openings 166 can have a noncircular shape in some implementations. At least some of the other parts can also be designed differently or be omitted. Other variants are possible as well.

FIG. 6 also shows the valve member 172 and its outer circumferential groove 186 provided to receive the valve gasket 176. Other configurations and arrangements are possible. Among other things, the valve gasket 176 can be entirely omitted in some implementations, for instance if the material and the configuration of the parts already provide a suitable sealing engagement for the intended use. At least some of the other parts can also be designed differently or be omitted. Other variants are possible as well.

The spout 100 can include a short middle stem 192 that is orthogonally projecting from the inner side of the valve member 172 and that is positioned right at its center thereof between the two stems 182, as shown for instance in FIG. 6. This middle stem 192 can be essentially a remnant of the molten plastic resin injection process used to manufacture the parts. It can correspond to the passageway for the molten plastic material in the mold. The shallow hole visible near the free end can also be the result of the injection molding process. The presence of the middle stem 192 can be useful to further reinforce the junctions of the stems 182 with the inner side of the valve member 172. Other configurations, arrangements, materials and manufacturing processes are possible as well. Among other things, the middle stem 192 can be removed during the manufacturing process or can be entirely omitted in some implementations. Other variants are possible as well.

Figure 7:
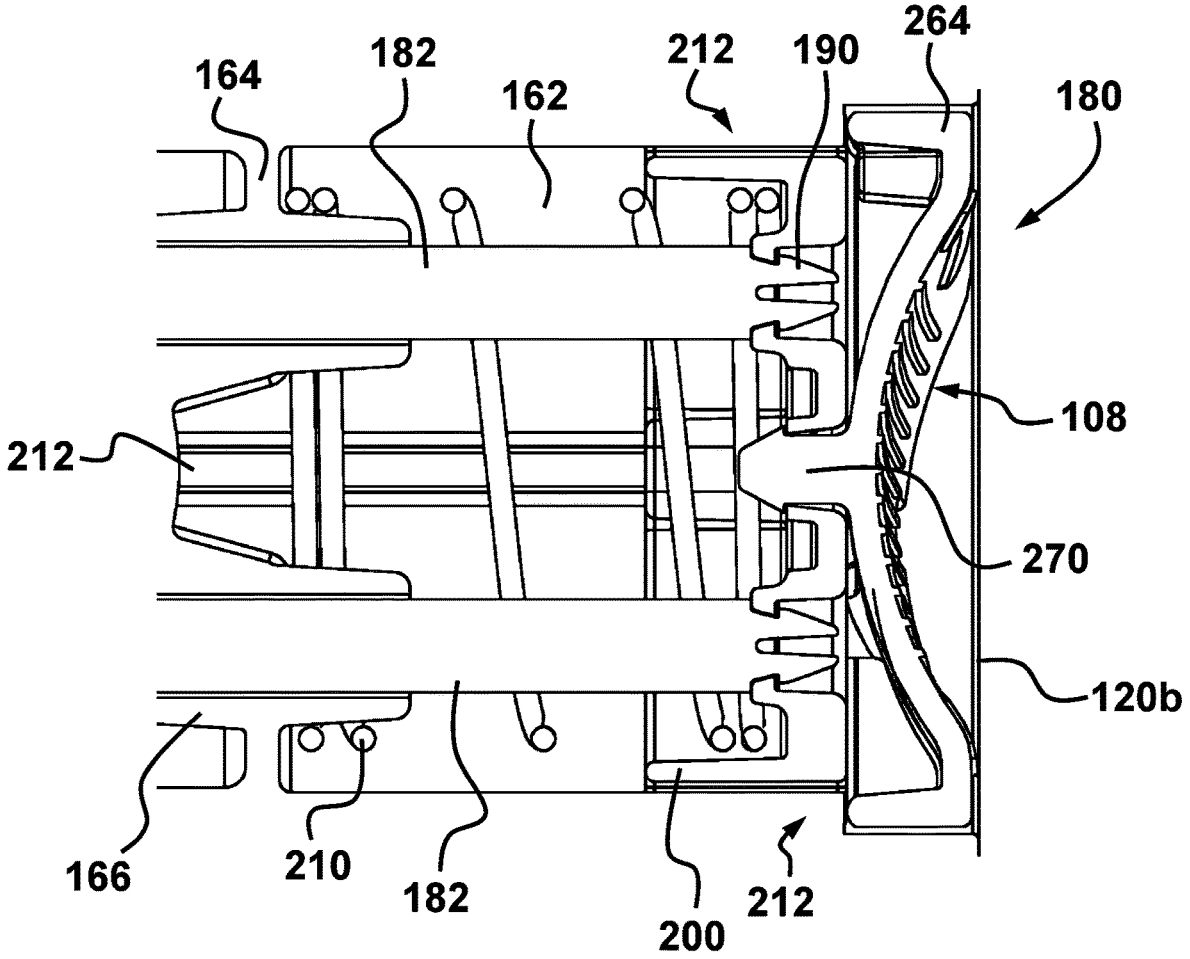
FIG. 7 is an enlarged view of the area inside the broken line in FIG. 5.

FIG. 7 is an enlarged view of the area inside the broken line in FIG. 5. Each stem 182 can have, at its tip, a corresponding connector 190 configured to engage in a snap-fit engagement a corresponding stem socket 202 provided on a sliding member 200, as shown. This sliding member 200 can be seen in cross section in FIG. 7 and further details will follow later. The sockets 202 are best shown in FIGS. 22 to 26. Other configurations and arrangements are possible. Among other things, other kinds of connectors are possible. Other variants are possible as well.

The valve system 170 can include a biasing element 210, for instance a helical return spring, positioned inside the housing 162 to urge the valve member 172 in the normally closed position when no actuating force is applied by a user on the push button 108, as shown in FIGS. 5 and 7. This biasing element 210 is located on the dry side and is concealed inside the spout 100 in the illustrated example. It can be set between the partition 164 and the inner side of the sliding member 200, as shown. The biasing element 210 can also counterbalance an actuating force applied on the push button 108 by the user when the valve member 172 is open. Other configurations and arrangements are possible. Among other things, other kinds of biasing elements are possible, and the biasing element can be positioned differently inside the spout 100. Other variants are possible as well.

FIGS. 3 and 5 show that the housing 162 can include spaced apart elongated longitudinally extending inner ribs 212. There are four axisymmetric longitudinal ribs 212 in the illustrated example, and these longitudinal ribs 212 are integrally formed on the inner surface of the housing 162 to guide the sliding member 200 as well as the push button 108. The presence of the longitudinal ribs 212 can also improve the structural rigidity of the first member 120. Nevertheless, other configurations and arrangements are possible. Among other things, the number of longitudinal ribs 212, their relative position, or even both, can be different. The longitudinal ribs 212 can be replaced by other features, such as slots made into the inner surface of the housing 162. They can also be entirely omitted in some implementations. Other variants are possible as well.

Figure 8:
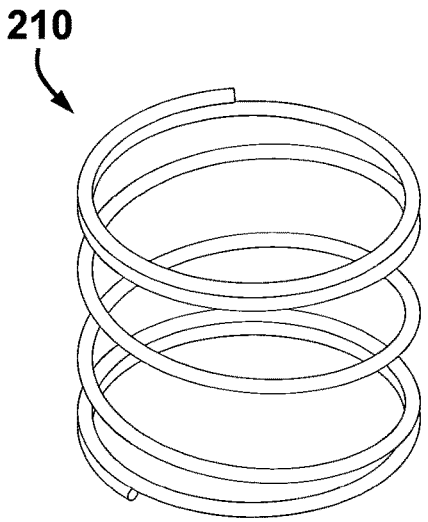
FIG. 8 is an isometric view of the biasing element of the spout shown in FIG. 1.

FIG. 8 is an isometric view of the biasing element 210 of the spout 100 shown in FIG. 1. As aforesaid, although the biasing element 210 can be in the form of a helical return spring in the illustrated example, other kinds of biasing elements are also possible.

Figure 9:
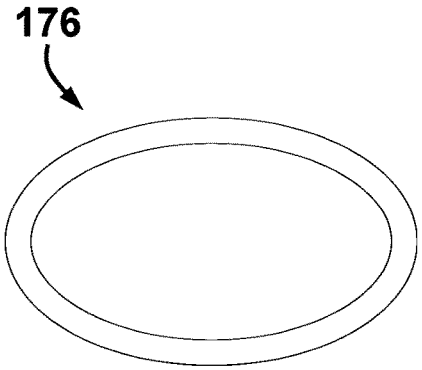
FIG. 9 is a semi-schematic isometric view of the valve gasket of the spout shown in FIG. 1.

FIG. 9 is a semi-schematic isometric view of the valve gasket 176 of the spout 100 shown in FIG. 1. Other kinds of gaskets are also possible.

Figure 10:
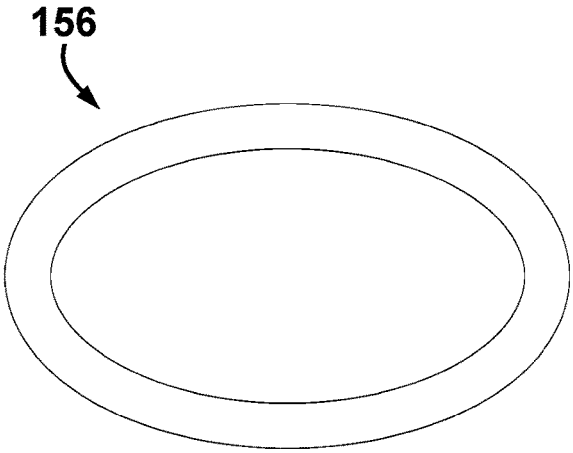
FIG. 10 is a semi-schematic isometric view of the outer gasket of the spout shown in FIG. 1.

FIG. 10 is a semi-schematic isometric view of the outer gasket 156 of the spout 100 shown in FIG. 1. Other kinds of gaskets are also possible. The outer gasket 156 can be entirely omitted in some implementations.

Figure 11:
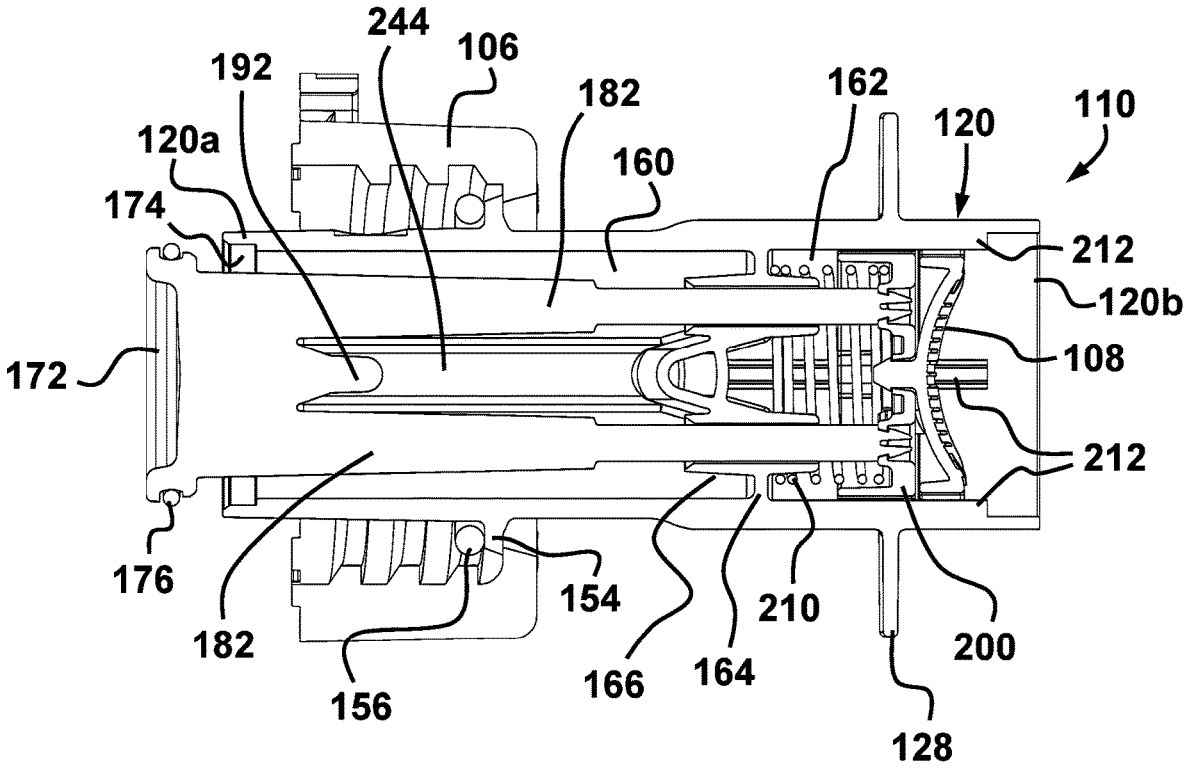
FIG. 11 corresponds to the view of FIG. 5 when the spout is partially open.
Figure 12:
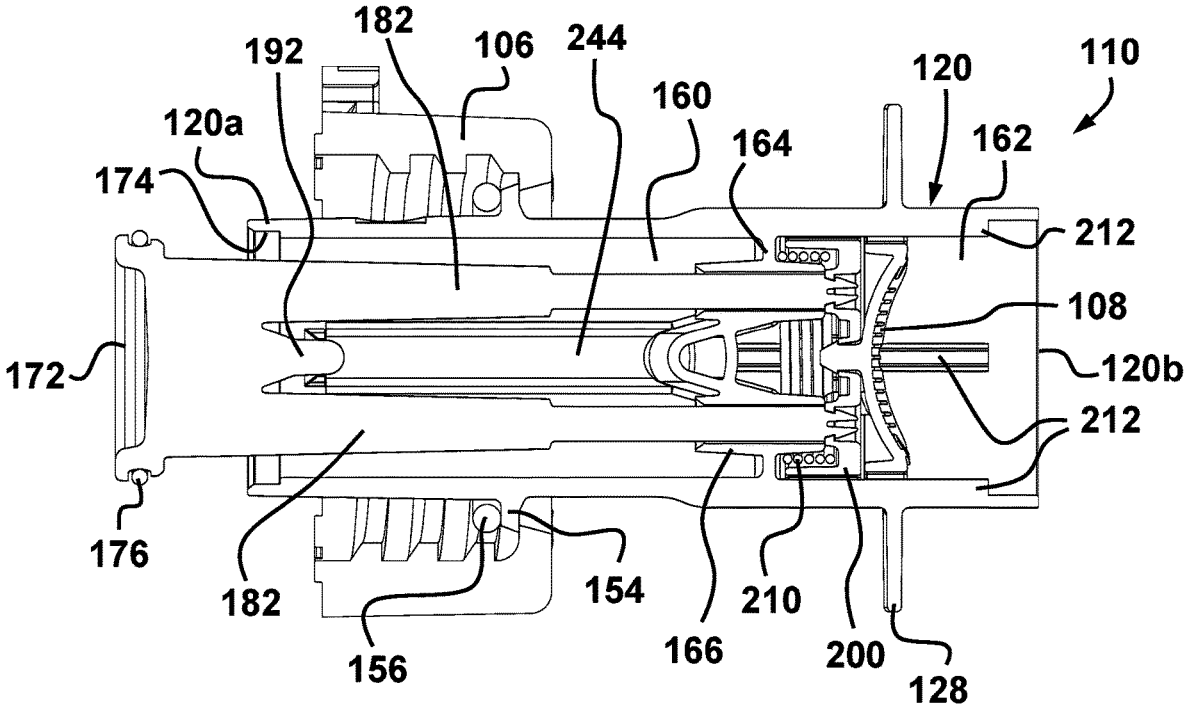
FIG. 12 corresponds to the view of FIG. 5 when the spout is fully open.

FIGS. 11 and 12 correspond, respectively, to the view of FIG. 5 when the spout 100 is partially open and fully open. These figures show that the biasing element 210 inside the housing 162 can be progressively compressed when the valve member 172 is pushed further away from the first open end 120*a* into the container 102. The biasing element 210 can even become fully compressed or almost fully compressed at the fully opened position. At the fully opened position, the push button 108 can be at its deepest point within the housing 162, as shown in FIG. 12. Other configurations and arrangements are possible. Among other things, although the push button 108 is shown being substantially flush with the second open end 120*b* at the normally closed position, the push button 108 can extend beyond the second open end 120*b* in some implementations or be deeper inside the housing 162. Other variants are possible as well.

Figure 13:
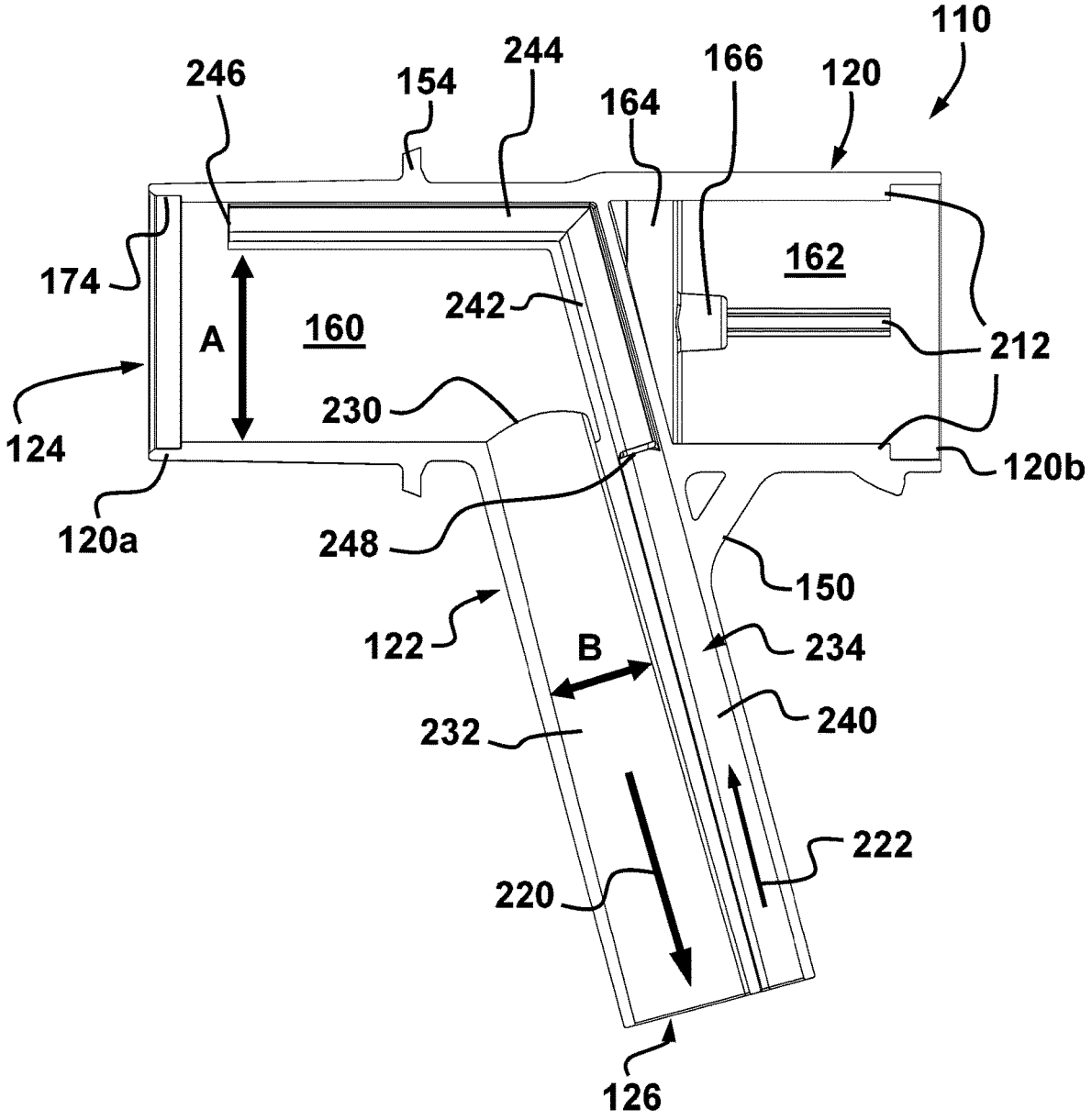
FIG. 13 is a medial cross section view of only the main body of the spout shown in FIG. 1.

FIG. 13 is a medial cross section view of only the main body 110 of the spout 100 shown in FIG. 1. FIG. 13 thus shows the main body 110 without the other parts, including without the extension conduit 140. The spout tip 126 is then the free end of the second member 122 in the context. The liquid circuit inside the spout 100 is schematically depicted at 220, and the air circuit is schematically depicted at 222. As shown in the illustrated example, the liquid circuit 220 can pass inside the liquid chamber 160 and exit the first member 120 through a side opening 230 thereof before passing inside a liquid passageway 232 that extends within the second member 122. The air circuit 222 can pass through an air passageway 234. This air circuit 222 is segregated from the liquid circuit 220 in the illustrated example. The air passageway 234 can maintain the separation between both circuits 220, 222 along the entire length thereof, with the exception of a short distance of a few millimeters or less at the spout base 124, in the area right underneath the inner side of the valve member 172, namely where the air can exit the air passageway 234 when the valve member 172 is open. Other configurations and arrangements are possible. Among other things, at least some of these parts can be designed differently or be omitted. Other variants are possible as well.

As schematically depicted in FIG. 13, the liquid chamber 160 can have a cross section area A that is wider than the cross section area B of the liquid passageway 232 inside the second member 122, for instance more than twice, as shown in the illustrated example. This can cause the liquid chamber 160 to be entirely filled with liquid when, among other things, pouring while the valve member 172 is at the fully opened position and the spout base 124 is constantly immersed with liquid from the container 102, for instance because the container 102 is tilted by the user to direct the maximum amount of liquid towards the spout base 124. The liquid entering the liquid chamber 160 can push the liquid already present at the opposite end through the side opening 230 at the bottom end of the liquid chamber 160. As shown, this side opening 230 can be located substantially at the intersection between the first and second members 120, 122, and the liquid circuit can pass through this side opening 230. The cross section area of the liquid passageway 232 is substantially constant in the illustrated example. The liquid passageway 232 can also be longer than the longitudinal length of the liquid chamber 160. Other configurations and arrangements are possible. Among other things, at least some of these parts can be designed differently or be omitted. Other variants are possible as well.

The air passageway 234 can include three consecutive segments, namely a first segment 240, a second segment 242 and a third segment 244 disposed in juxtaposition, as shown in the illustrated example. Air can enter the air passageway 234 at the spout tip 126 and can exit the air passageway 234 at its downstream end 246. The first segment 240 of the air passageway 234 can be positioned along a top inner side of the second member 122, as shown for instance in FIG. 13. This top inner side can be almost always vertically above adjacent parts of the liquid passageway 232 inside the second member 122. The first segment 240 can be parallel to the liquid passageway 232. The second segment 242 is located in the first member 120 and is in registry with the first segment 240 in the illustrated example. Still, a small intermediary air restriction 248 can be provided at the junction between the first and second segments 240, 242 to accelerate the airflow. Both the first and the second segment 240, 242 are rectilinear in the illustrated example. Other configurations and arrangements are possible. Among other things, the first and the second segment 240, 242 could be seamlessly integrated. The intermediary air restriction 248 can be entirely omitted in some implementations. At least some of the other parts can also be designed differently or be omitted. Other variants are possible as well.

The third segment 244 of the air passageway 234 can be positioned along a top inner side of the liquid chamber 160 and can extend up to the downstream end 246, as shown. The second segment 242 interconnects the first and third segments 240, 244, and the third segment 244 is rectilinear in the illustrated example. Other configurations and arrangements are possible.

Among other things, at least some of these parts can be designed differently or be omitted. Other variants are possible as well.

FIG. 14 is a front view of only the main body 110 of the spout 100 shown in FIG. 1. FIG. 14 shows, among other things, that the air passageway 234 can follow the top side of the main body 110 and can remain in a straight line, only changing direction between the second and third segments 242, 244. This air passageway 234 is in registry with the medial plane 136 over its entire length. There is no deviation to the side, and no other part crosses this path in the illustrating example. Still, in the example, the stems 182 pass on a respective lateral side of the second segment 242 and thus, no deviation of the second segment 242 is required and the stems 182 do not interfere with the air circuit 222 since they do not extend across the air passageway 234. The air passageway 234 has a substantially V-shaped cross section at the downstream end 246 in the illustrated example. Other configurations and arrangements are possible. Among other things, at least some of these parts can be designed differently or be omitted. Other variants are possible as well.

FIG. 14 further illustrates that the openings 166 can be positioned in perpendicular alignment with reference to the medial plane 136. They are thus positioned in registry with a lateral plane 152 in the illustrated example. The intersection between the medial plane 136 and the lateral plane 152 corresponds to the longitudinal axis 130 of the first member 120 in the illustrated example. Other configurations and arrangements are possible. Among other things, at least some of these parts can be designed differently or be omitted. Other variants are possible as well.

Figure 15:
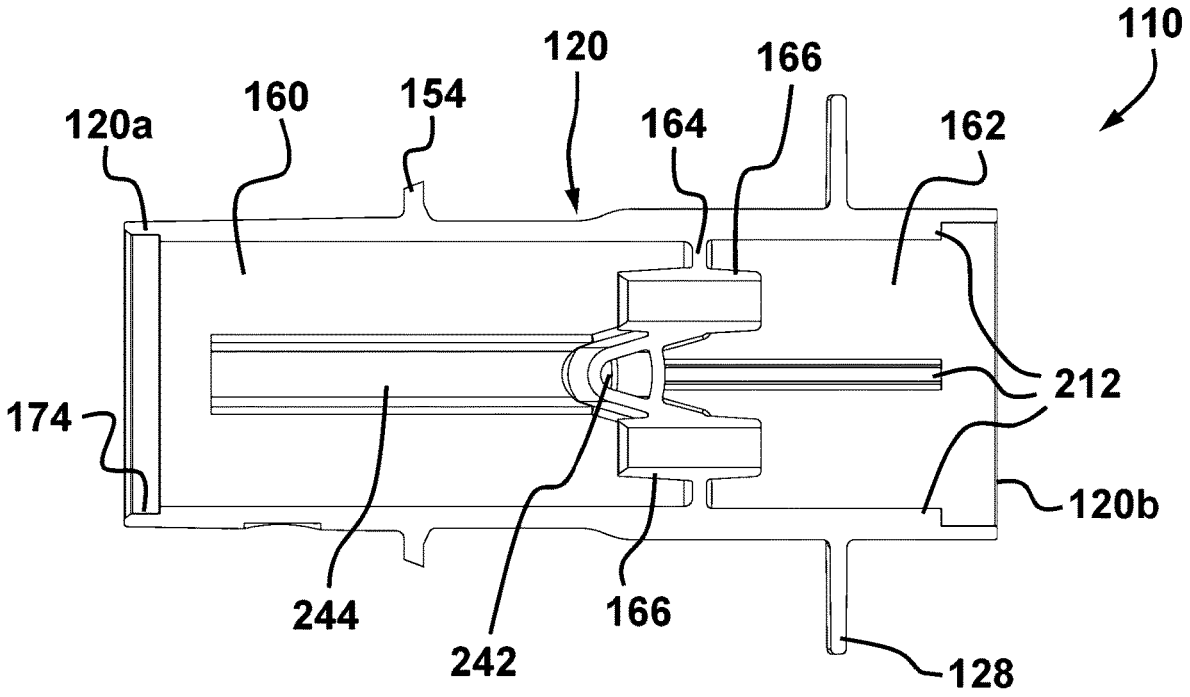
FIG. 15 is a lateral cross section view of only the first member of the spout shown in FIG. 1.

FIG. 15 is a lateral cross section view of only the first member 120 of the spout 100 shown in FIG. 1. It shows the interior of the first member 120 as viewed from the bottom. The second segment 242 is only partially visible because of the cross section. As shown in the illustrated example, the longitudinal ribs 212 can end a few millimeters before reaching the edge of the second open end 120*b* of the first member 120. This can create an annular interior area, immediately below the second open end 120*b*. Other configurations and arrangements are possible. Among other things, at least some of these parts can be designed differently or be omitted. Other variants are possible as well.

Figure 16:
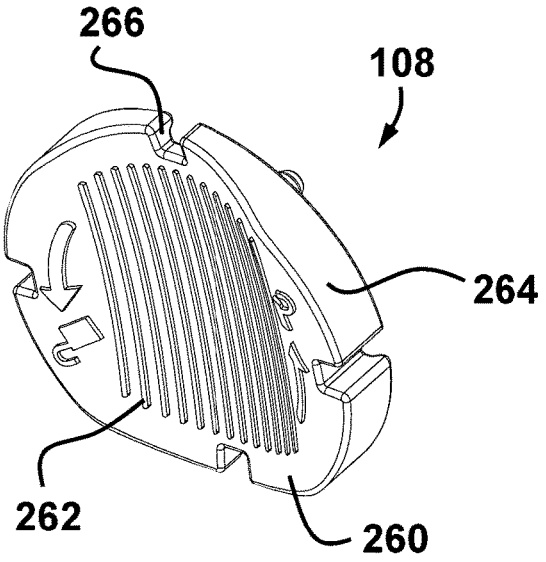
FIGS. 16 to 21 are views illustrating the push button of the spout shown in FIG. 1.

FIGS. 16 to 21 are views illustrating the push button 108 of the spout 100 shown in FIG. 1. FIG. 16 is a front isometric view thereof. As can be seen, the push button 108 can include a concave front face 260 provided with surface gripping features 262 to enhance the finger contact engagement. These gripping features 262 are in the form of small spaced-apart and parallel ribs in the illustrated example. The front face 260 of the push button 108 can further include optional visual indicators in the form of pictograms depicting how to unlock the CRC device 180, as shown, and the push button 108 can also include a rearwardly projecting rim 264 located at its outer periphery. The outer periphery of the push button 108 can have a circular shape. However, as shown in the illustrated example, the outer periphery can be segmented by axisymmetric peripheral notches 266 extending axially, i.e., parallel to the longitudinal direction. The number, size, shape and configuration of these notches 266 can match that of the longitudinal ribs 212 or the like inside the housing 162. Other configurations and arrangements are possible. Among other things, other kinds of surface gripping features are possible. The surface gripping features can also be entirely omitted in some implementations. At least some of the other parts can be designed differently or be omitted. Other variants are possible as well.

Figure 17:
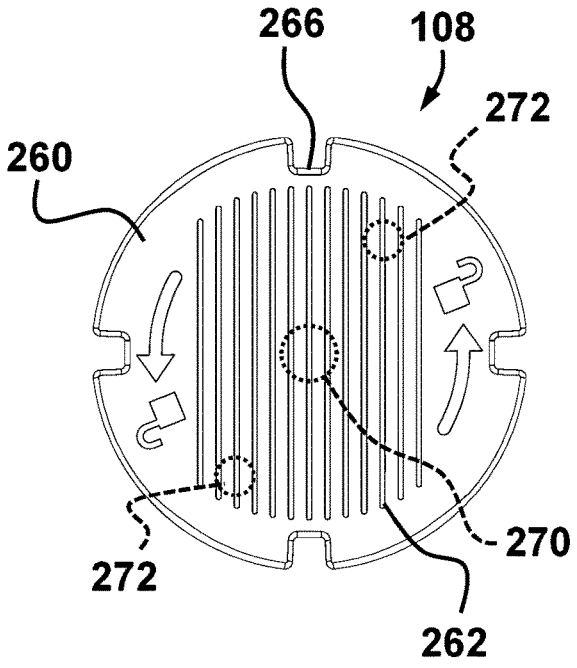
Figure 18:
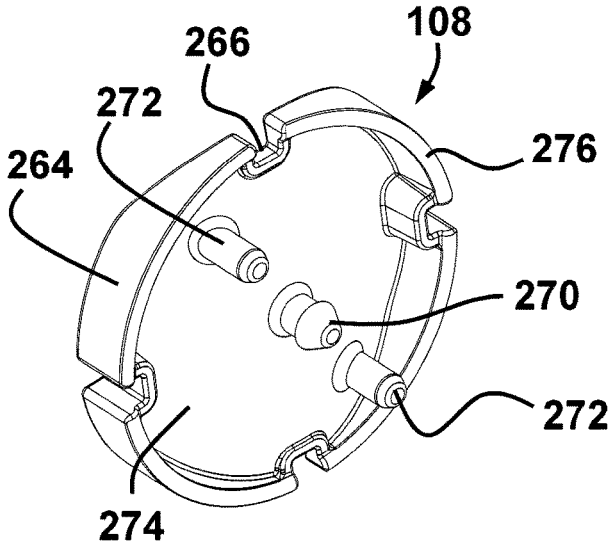

FIG. 17 is a front view of the push button 108 shown in FIG. 16. FIG. 18 is a rear isometric view thereof. As can be seen, the push button 108 can include a central mounting pin 270 projecting orthogonally at the back thereof. This central mounting pin 270 includes a larger portion at its free end in the illustrated example, which allows it to be attached with a snap-fit engagement to the sliding member 200 during manufacturing. Other configurations and arrangements are possible. Among other things, at least some of these parts can be designed differently or be omitted. Other variants are possible as well.

The push button 108 can include two axisymmetric positioning pins 272 orthogonally projecting from the rear face 274 thereof, as shown. These pins 270, 272 are positioned in a radial alignment in the illustrated example, including with the central mounting pin 270, and they also are integrally formed with the rest of the push button 108. The pins 270, 272 can have a substantially cylindrical shape. Other configurations and arrangements are also possible. Among other things, at least some of these parts can be designed differently or be omitted. Other variants are possible as well.

Figure 19:
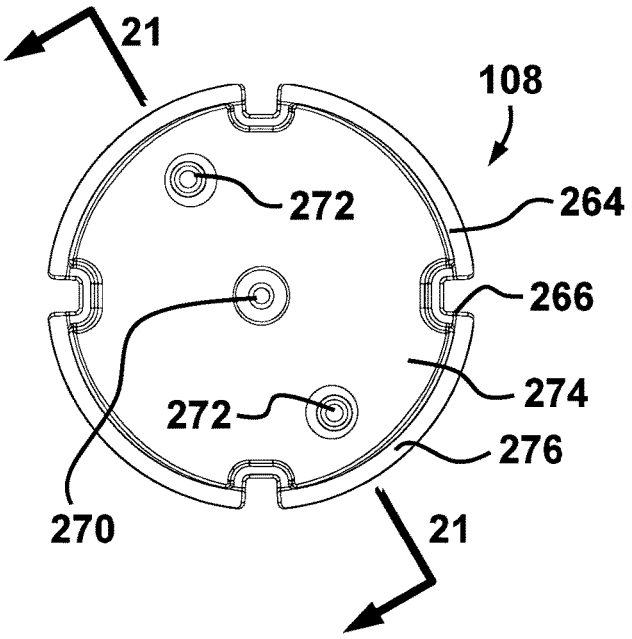
Figure 20:
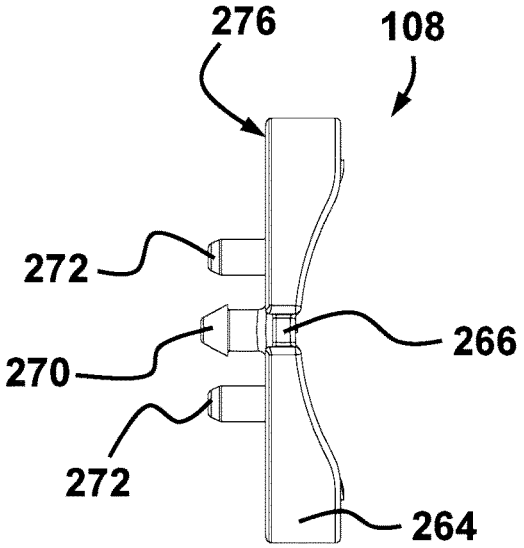
Figure 21:
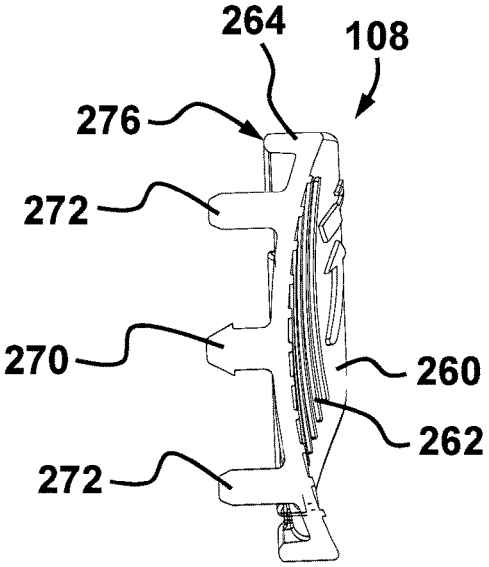

FIG. 19 is a rear view of the push button 108 shown in FIG. 16. FIG. 20 is a side isometric view thereof, and FIG. 21 is a cross section view along line 21-21 in FIG. 19. As can be seen, the rear edge of the rearwardly projecting rim 264 can be flat and can form a radially extending rear annular surface 276. This annular surface 276 can engage the front side of the sliding member 200 and can pivot thereon in the illustrated example. It can further engage the top end surface of the longitudinal ribs 212 in this example. Other configurations and arrangements are possible. Among other things, at least some of these parts can be designed differently or be omitted. Other variants are possible as well.

Figure 22:
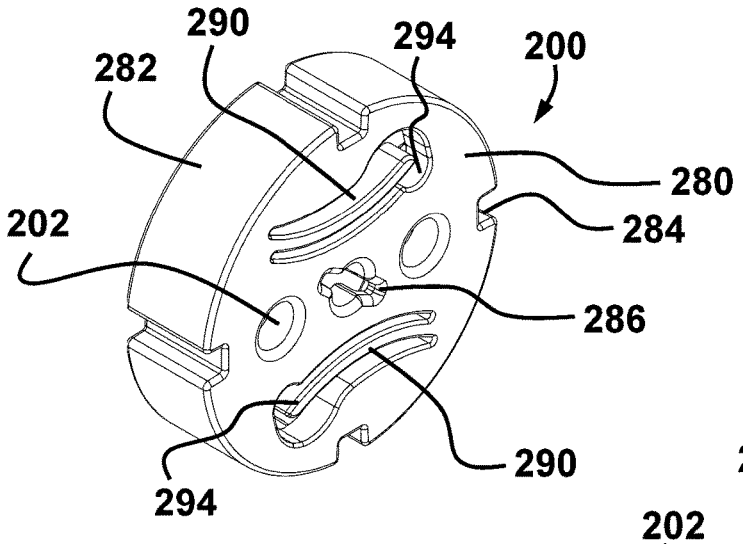
FIGS. 22 to 26 are views illustrating the sliding guide member of the spout shown in FIG. 1.
Figure 23:
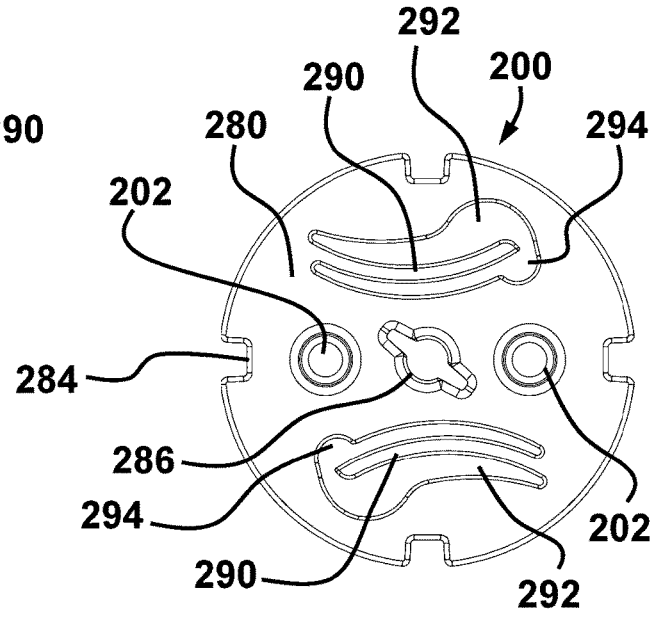
Figure 24:
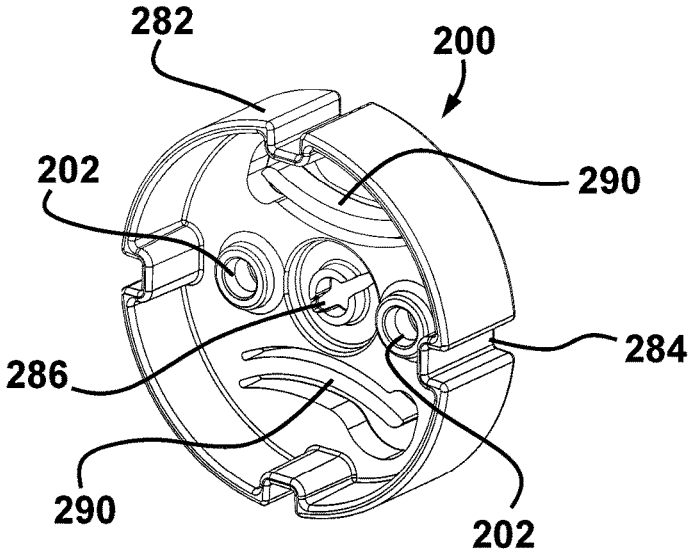

FIGS. 22 to 26 are views illustrating the sliding member 200 of the spout 100 shown in FIG. 1. FIGS. 22 to 24 are, respectively, a front isometric view, a front view and a rear isometric view thereof. As can be seen, the sliding member 200 can include a radially extending main portion 280 having a rearwardly projecting rim 282 at its outer periphery and extending longitudinally on the rear side. The sliding member 200 can also include axisymmetric peripheral notches 284 similar to the notches 266 of the push button 108. Other configurations and arrangements are also possible. Among other things, at least some of these parts can be designed differently or be omitted. Other variants are possible as well.

The sliding member 200 can have a central mounting hole 286 configured and disposed to receive the central mounting pin 270 at the back of the push button 108 in a snap-fit engagement, as shown. The central mounting hole 286 in the illustrated example has a substantially oblong shape and it is slotted to facilitate the insertion of the central mounting pin 270, more particularly to facilitate the insertion of its larger end portion. The larger end portion of the central mounting pin 270 can be positioned immediately behind the rear edge of the central mounting hole 286 once the insertion is completed. The connection between the central mounting pin 270 and the corresponding central mounting hole 286, however, will not prevent the push button 108 from pivoting with reference to the sliding member 200. Other configurations and arrangements are possible. Among other things, at least some of these parts can be designed differently or be omitted. Other variants are possible as well.

The sliding member 200 can include, as aforesaid, the two spaced-apart sockets 202 to receive a corresponding one of the connectors 190 at the free end of the stems 182, as shown in the illustrated example. The two sockets 202 can be in a radial alignment with two of the notches 284, the other two notches 284 being positioned 90 degrees apart on either side of the sliding member 200 in the illustrated example. Other configurations and arrangements are possible in certain implementations. Among other things, at least some of these parts can be designed differently or be omitted. Other variants are possible as well.

The sliding member 200 can be part of the CRC device 180 when, as shown in the illustrated example, it includes a biasing system therein to set the CRC device 180 in the normally locked state. It can include two cantilever spring blades 290 to generate a torque on the push button 108. These spring blades 290 can be somewhat tangentially oriented and be made integral with the main portion 280 of the sliding member 200. Each spring blade 290 can be molded within the sliding member 200 itself and, accordingly, the plastic material can be selected to yield the desired mechanical properties. Each spring blade 290 can extend within a somewhat arc-shaped slot 292 provided on the main portion 280. Each slot 292 can also include a recessed area 294 where a corresponding one of the positioning pins 272 of the push button 108 can be located when the CRC device 180 is in the normally locked state, as shown in the illustrated example. Other configurations and arrangements are possible. Among other things, at least some of these parts can be designed differently or be omitted. Other variants are possible as well.

Figure 25:
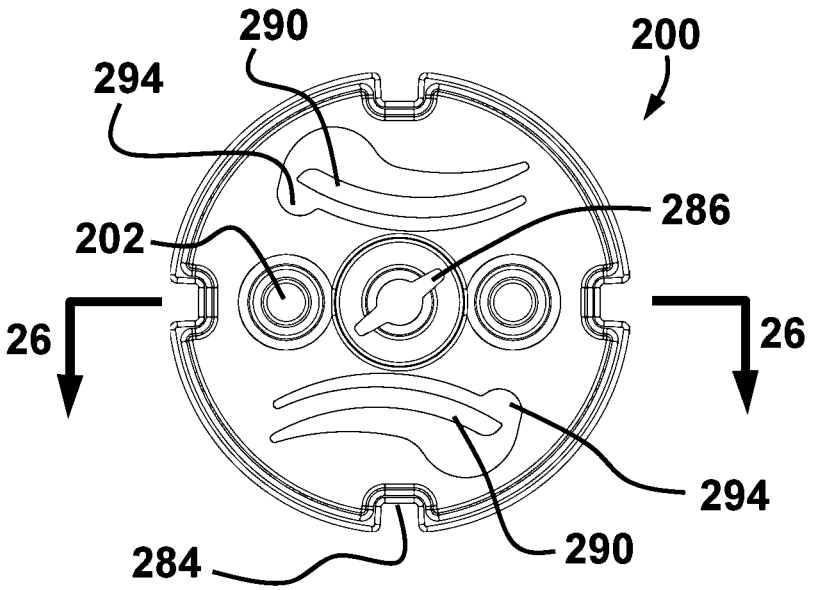
Figure 26:
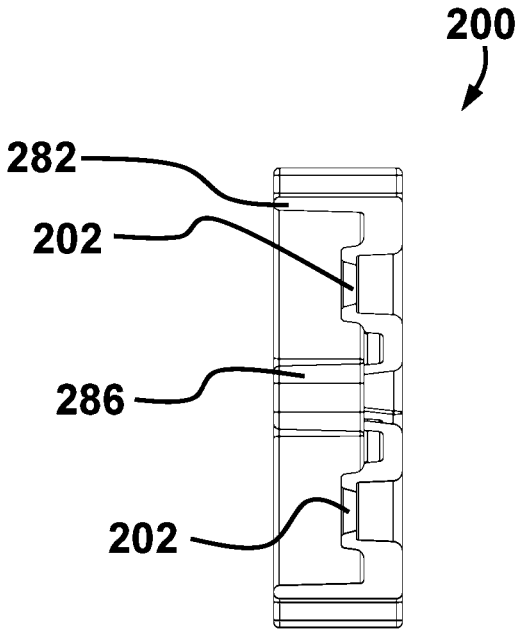

FIG. 25 is a rear view of the sliding member 200 shown in FIG. 22. FIG. 26 is a cross section view taken along line 26-26 in FIG. 25.

Figure 27:
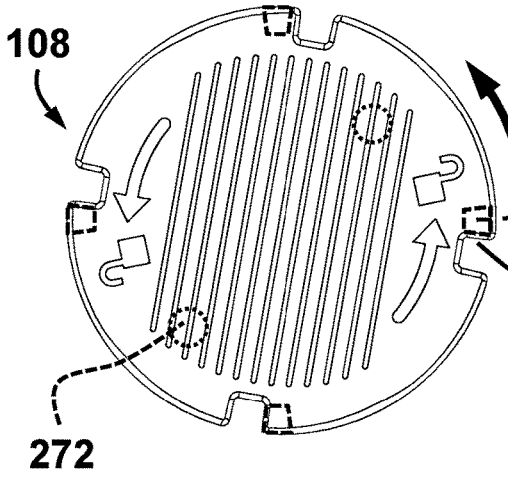
FIGS. 27 to 30 are semi-schematic views depicting the operation the CRC device of the spout shown in FIG. 1.

FIGS. 27 to 30 are semi-schematic views depicting how operates the CRC device 180 of the spout 100 shown in FIG. 1. In particular, FIG. 27 is a front view of the push button 108 shown in FIG. 16. The illustrated angular position of the push button 108 corresponds to the normally locked state of the CRC device 180 because the notches 266 on the periphery of the push button 108 are not in registry with the longitudinal ribs 212 inside the housing 162. The longitudinal ribs 212 are semi-schematically depicted in FIG. 27. As aforesaid, the longitudinal ribs 212 can end a few millimeters before reaching the edge of the second open end 120*b* of the first member 120, as shown. This can create an annular interior area, immediately below the second open end 120*b*, where the notches 266 of the push button 108 can be out of the longitudinal ribs 212, thereby allowing the push button 108 to pivot just enough to bring the notches 266 out of registry with the longitudinal ribs 212. The annular surface 276 can engage the top end surface of each of the longitudinal ribs 212, as shown in FIG. 27. This can prevent the push button 108 from being pushed inside the housing 162, thus the valve member 172 from opening. The sliding member 200, being in engagement with the longitudinal ribs 212, does not pivot inside the housing 162. Other configurations and arrangements are possible. Among other things, at least some of these parts can be designed differently or be omitted. Other variants are possible as well.

Figure 28:
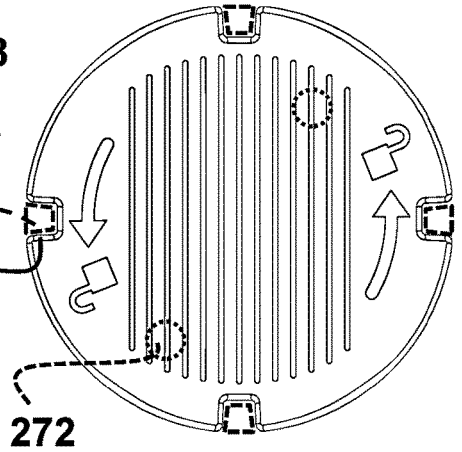

A torque T, schematically depicted in FIG. 27, can be applied by the user using a finger in the counter-clockwise direction to pivot the push button 108 in the illustrated example. FIG. 28 shows the relative position of the parts after the pivot motion and the CRC device 180 is now in an unlocked state. The torque T applied by the user, for instance using the thumb, can pivot the push button 108 until it reaches the angular position shown in FIG. 28. This unlocked state can be maintained either because the user continues to apply the torque T or because the user pressed on the push button 108 into the housing 162, causing the surfaces inside the notches 266 to engage the outer surfaces of the longitudinal ribs 212. Other configurations and arrangements are possible. Among other things, at least some of these parts can be designed differently or be omitted. Other variants are possible as well.

Figure 29:
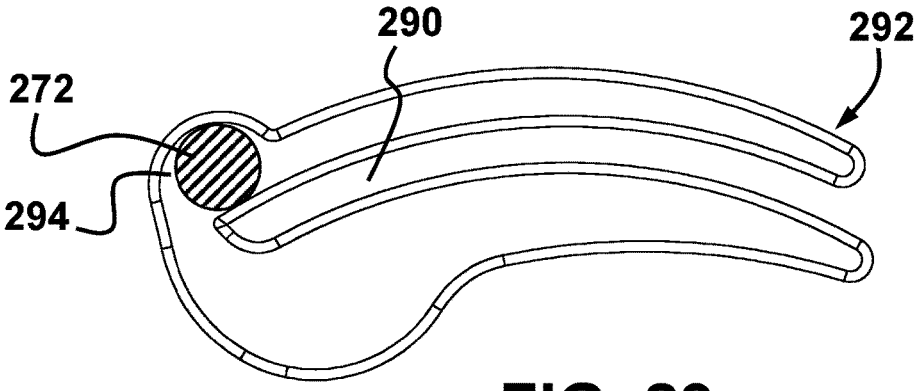

FIG. 29 is an enlarged view of only the spring blade 290 at the bottom of the sliding member 200 shown in FIG. 23 for the sake of explanation. This spring blade 290 can cooperate with the positioning pin 272, namely the one at the bottom left in FIGS. 27 and 28. FIG. 29 shows that the location of the positioning pin 272 can correspond to the angular position of the push button 108 shown in FIG. 27. The outer surface of the positioning pin 272 can engage the surface at the end of the corresponding recess area 294 within the arc-shaped slot 292. Other configurations and arrangements are possible. Among other things, at least some of these parts can be designed differently or be omitted. Other variants are possible as well.

Figure 30:
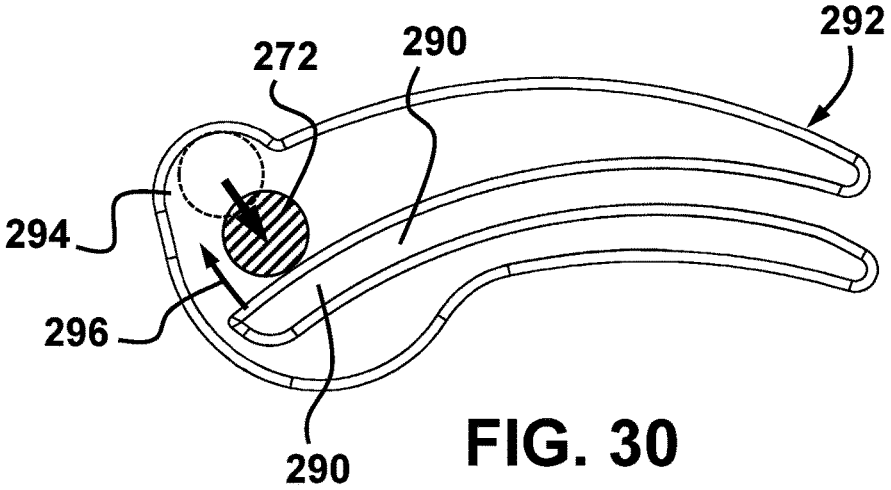

FIG. 30 is a view similar to FIG. 29 but shows the new position of the same positioning pin 272 once the push button 108 is in the angular position of FIG. 28. The original position of the positioning pin 272 is represented with a broken line for the sake of illustration. The arc-shaped motion of the positioning pin 272 can cause the corresponding spring blade 290 to be deflected, as shown. The deflection can create a spring force urging the positioning pin 272 back to its original position. This spring force is schematically depicted in FIG. 30 at 296. If the user stops applying a force on the push button 108, for instance upon letting go the push button 108 entirely, the spring force generated by both spring blades 290 on the sliding member 200 can reposition the push button 108 back to the position shown in FIG. 27, thus back to the locked position. However, once the notches 266 of the push button 108 are in engagement with the longitudinal ribs 212, no torque is required. If the user lets go the push button 108, the biasing element 210 of the valve system 170 first moves the valve member 172 against the valve seat 174 to close the spout 100, and since the push button 108 would then clear the longitudinal ribs 212, the pivot motion of the push button 108 can occur. Ultimately, the spout 100 can be back into its normally closed and its normally locked state. Other configurations and arrangements are possible. Among other things, at least some of these parts can be designed differently or be omitted. Other variants are possible as well.

Overall, providing the spring blades 290 with enough spring force can prevent young children from opening the spout 100 to access the content of the container 102. The spring force from the two spring blades 290 can easily generate a force beyond what children up to six years old can apply on the push button 108. The relatively small size of their fingers also contributes to the difficulty from them. Most of the older general population, however, should be able to operate the spout 100. Still, one can select a relatively soft biasing element 210 to generate a return force since this spring force is not what is preventing the access. A somewhat softer spring can yield many advantages, such as a very precise control and ease of use, among other things.

Figure 31:
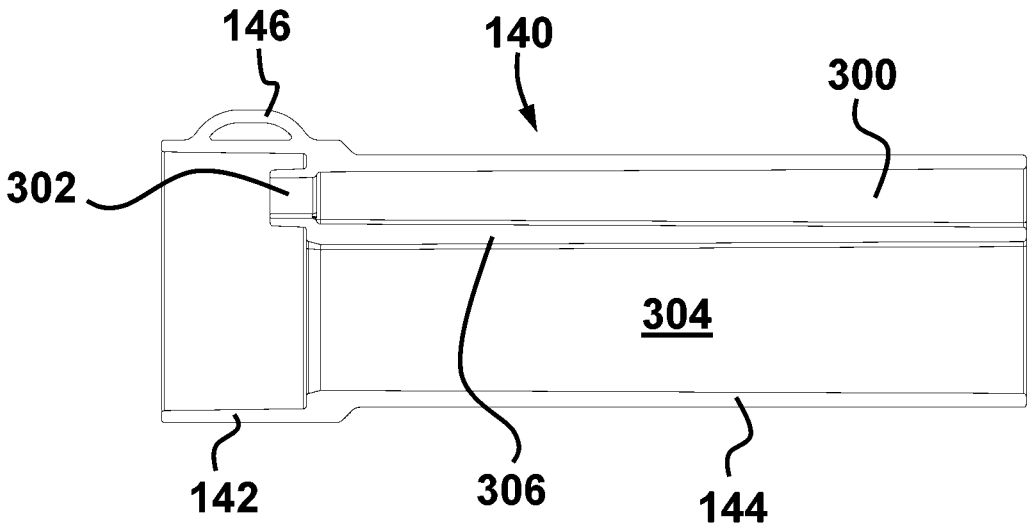
FIG. 31 is a medial cross section view of the extension conduit of the spout shown in FIG. 1.

FIG. 31 is a medial cross section view of the extension conduit 140 of the spout 100 shown in FIG. 1. As can be seen, FIG. 31 shows that the air duct 300 inside the extension conduit 140 of the illustrated example can have a tapered projecting portion 302 at its downstream end. This tapered projecting portion 302 can extend within the socket portion 142 and be designed to fit into the upstream end of the first segment 240 (FIG. 13) of the air passageway 234 inside the second member 122. The tapered projecting portion 302 can force the user to correctly align the parts when attaching the extension conduit 140. The air duct 300 can be segregated from the liquid duct 304 by an intervening partition 306. Other configurations and arrangements are possible. Among other things, at least some of these parts can be designed differently or be omitted. Other variants are possible as well.

FIG. 31 further shows that the extension conduit 140 can also include a liquid duct 304 in registry with the liquid passageway 232 inside the second member 122. The liquid duct 304 of the extension conduit 140 can then become a prolongation of the liquid passageway 232. The length of the liquid passageway 232 can be increased by an extension conduit 140. The extension conduit 140 can add, for instance, about 10 cm and bring its total length to about 18 cm (7 inches). This additional length can also further increase the maximum flow coming out of the container 102 because of the enhanced suction effect due to the additional liquid pulled by the gravity during pouring. Other configurations, arrangements and dimensions are possible. Among other things, at least some of these parts can be designed differently or be omitted. Other variants are possible as well.

Figure 32:
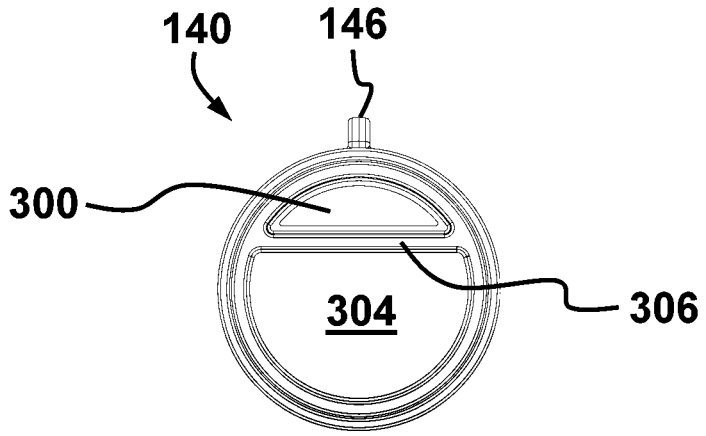
FIG. 32 is a front view at the tip of the extension conduit shown in FIG. 31.
Figure 33:
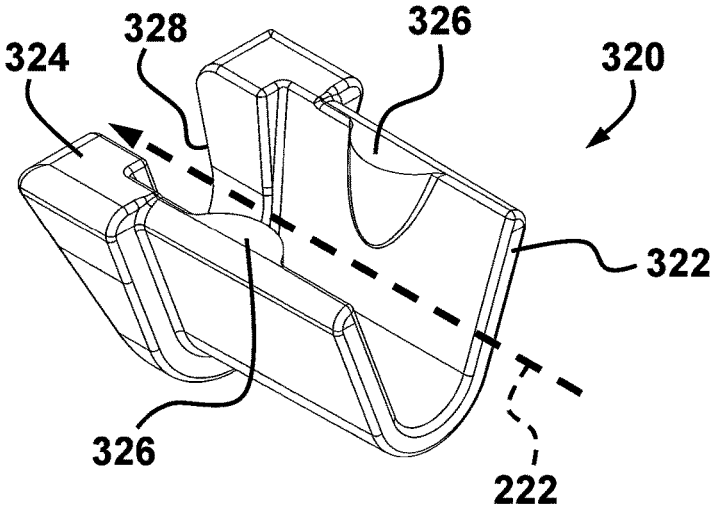
FIGS. 33 to 38 are views illustrating that the plug can form a constricted opening inside the spout shown in FIG. 1.
Figure 34:
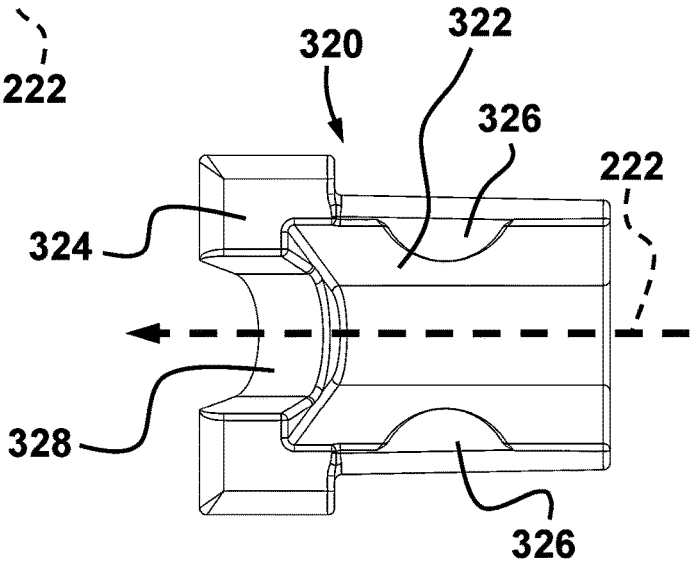
Figure 35:
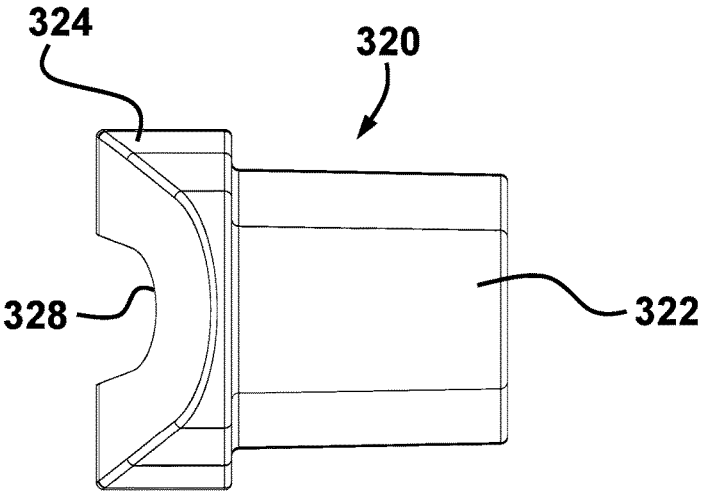
Figure 36:
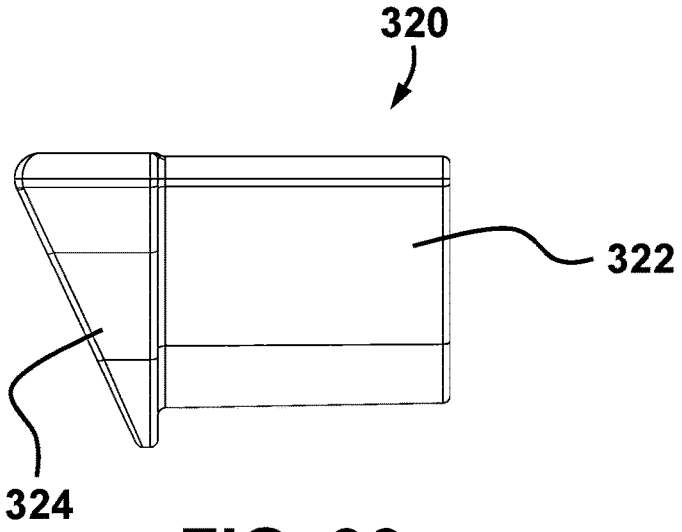
Figure 37:
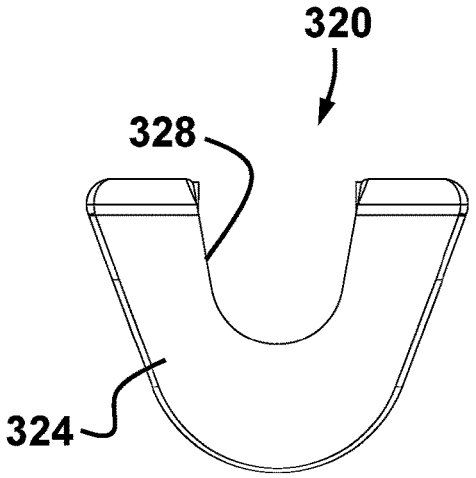
Figure 38:
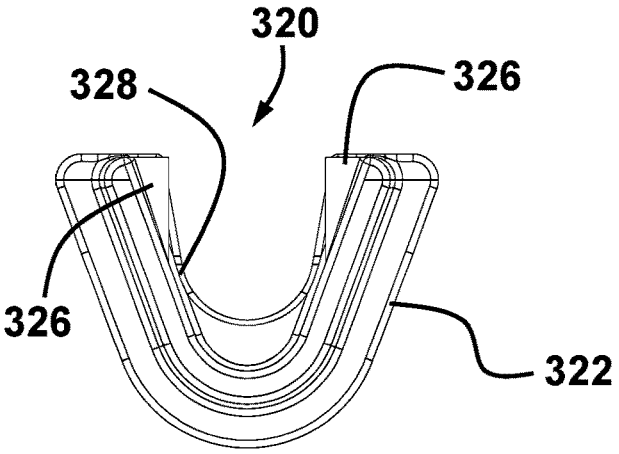

FIG. 32 is a front view at the tip of the extension conduit 140 shown in FIG. 31.

FIGS. 33 to 38 are views illustrating that the plug 320 can form a constricted opening inside the spout 100 shown in FIG. 1. This plug 320 can be a part added at the downstream end 246 of the air passageway 234 during manufacturing to accelerate the airflow before air enters the liquid to form bubbles inside the liquid of the container 102. The accelerated airflow can prevent the liquid from entering the air passageway 234 when the valve member 172 is open. Other configurations and arrangements are possible. Among other things, although the plug 320 can lower the manufacturing costs and reduce the complexity of manufacturing the spout 100, a constricted opening can be molded directly at the downstream end 246 of the air passageway 234. Some implementations may not require having a constricted opening. Other variants are possible as well.

The plug 320 of the illustrated example can restrict the cross section by a ratio of about 3. Other ratios are possible in other implementations. However, the configuration of the illustrated example can greatly mitigate the likelihood of having liquid entering into the air passageway 234 at the beginning of the pouring, even if the air passageway 234 is relatively very large in cross section to maximize the airflow. Keeping liquids out of the air passageway 234 can greatly improve the initial airflow and the liquid can start flowing out of the spout 100 very fast after opening the valve member 172.

The plug 320 can include an elongated upstream portion 322 and a downstream portion 324, as shown in the illustrated example. The outer surface of the upstream portion 322 can be designed to match the inner surface at the downstream end 246 of the air passageway 234, thereby allowing the insertion of the upstream portion 322 therein. It can be attached by an interference fit or by any other suitable method. The rear edge of the downstream portion 324 can abut against the front edge around the downstream end 246 of the air passageway 234, the plug 320 creating an extension of the air passageway 234 in the context. Two mutually facing rounded inner protuberances 326 can be provided inside the upstream portion 322 to facilitate the ejection of the plug 320 during the manufacturing process. The air can exit the plug 320 through an outlet opening 328 inside the downstream portion 324. This outlet opening 328 can have a cross section area that is smaller than that of the air passageway 234 at the downstream end 246 when the plug 320 is not present. Hence, an airflow restriction can be created by the presence of the plug 320, as shown in the illustrated example. Other configurations and arrangements are possible. Among other things, the inner protuberances 326 can be omitted in some implementations. At least some of the other parts can also be designed differently or be omitted. Other variants are possible as well.

Figure 39:
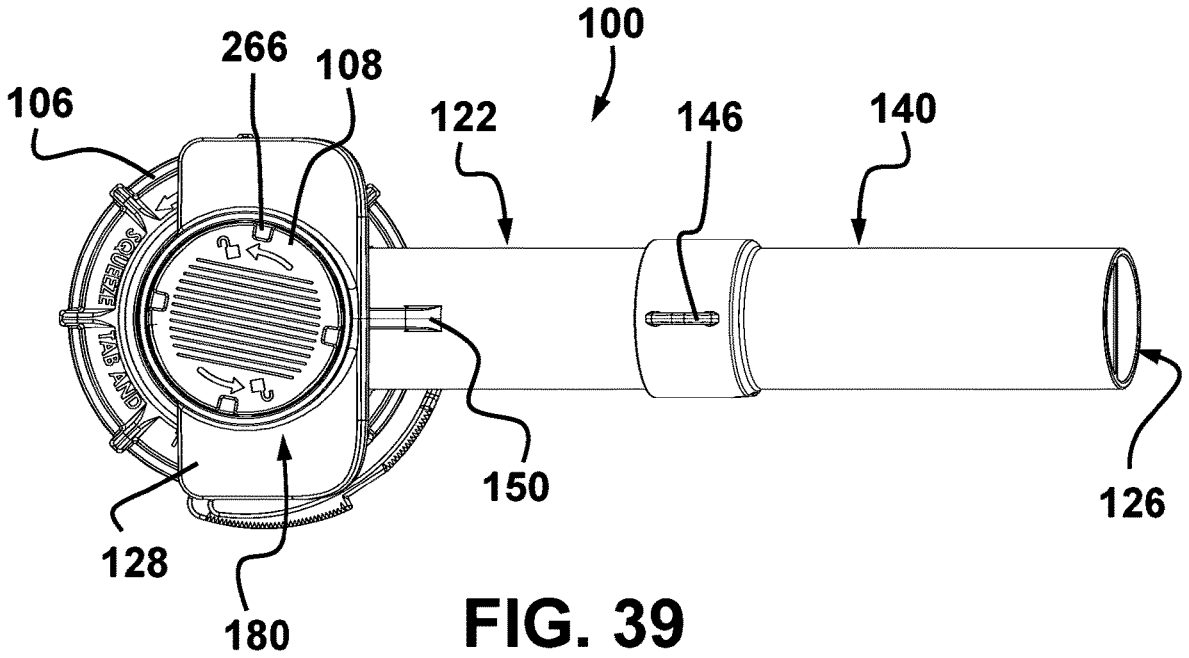
FIG. 39 is a top view of the spout shown in FIG. 1 when the CRC device is in the normally locked state.
Figure 40:
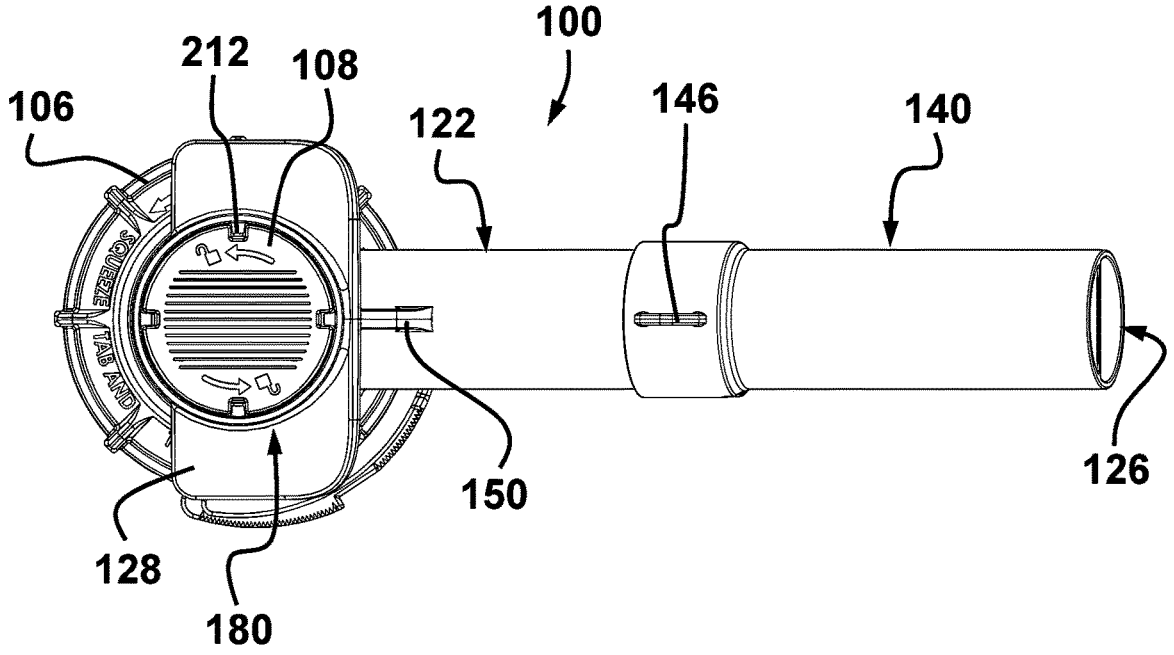
FIG. 40 is a view similar to FIG. 39 but showing the CRC device in the unlocked state.

FIG. 39 is a top view of the spout 100 shown in FIG. 1 when the CRC device 180 is in the normally locked state. A torque T can be applied by the user on the push button 108 to unlock it. FIG. 40 is a view similar to FIG. 39 but showing the CRC device 180 in the unlocked state because, in the illustrated example, the notches 266 on the periphery of the push button 108 are in registry with the end surfaces of the longitudinal ribs 212. The push bottom 108 can be pushed inside the housing 162, and this can bring the notches 266 in engagement with the longitudinal ribs 212. The torque T can be released but the user must keep pushing the push button 108 to keep it unlocked. Other configurations and arrangements are possible. Among other things, at least some of these parts can be designed differently or be omitted. Other variants are possible as well.

Figure 41:
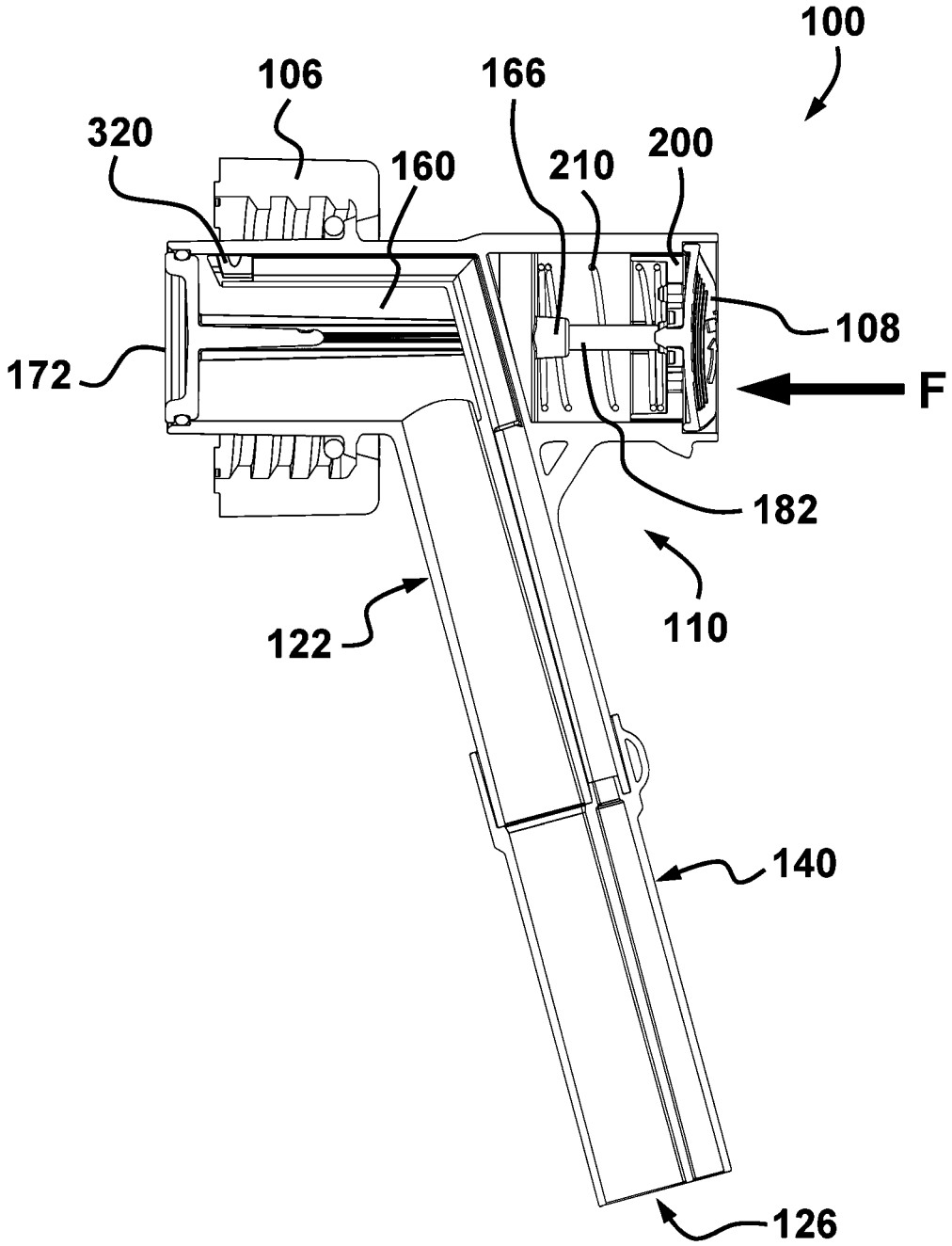
FIGS. 41 to 43 are sequential medial cross section views of the spout shown in FIG. 40 when the spout is, respectively, in the normally closed position, in a partially open position and in the fully opened position.
Figure 42:
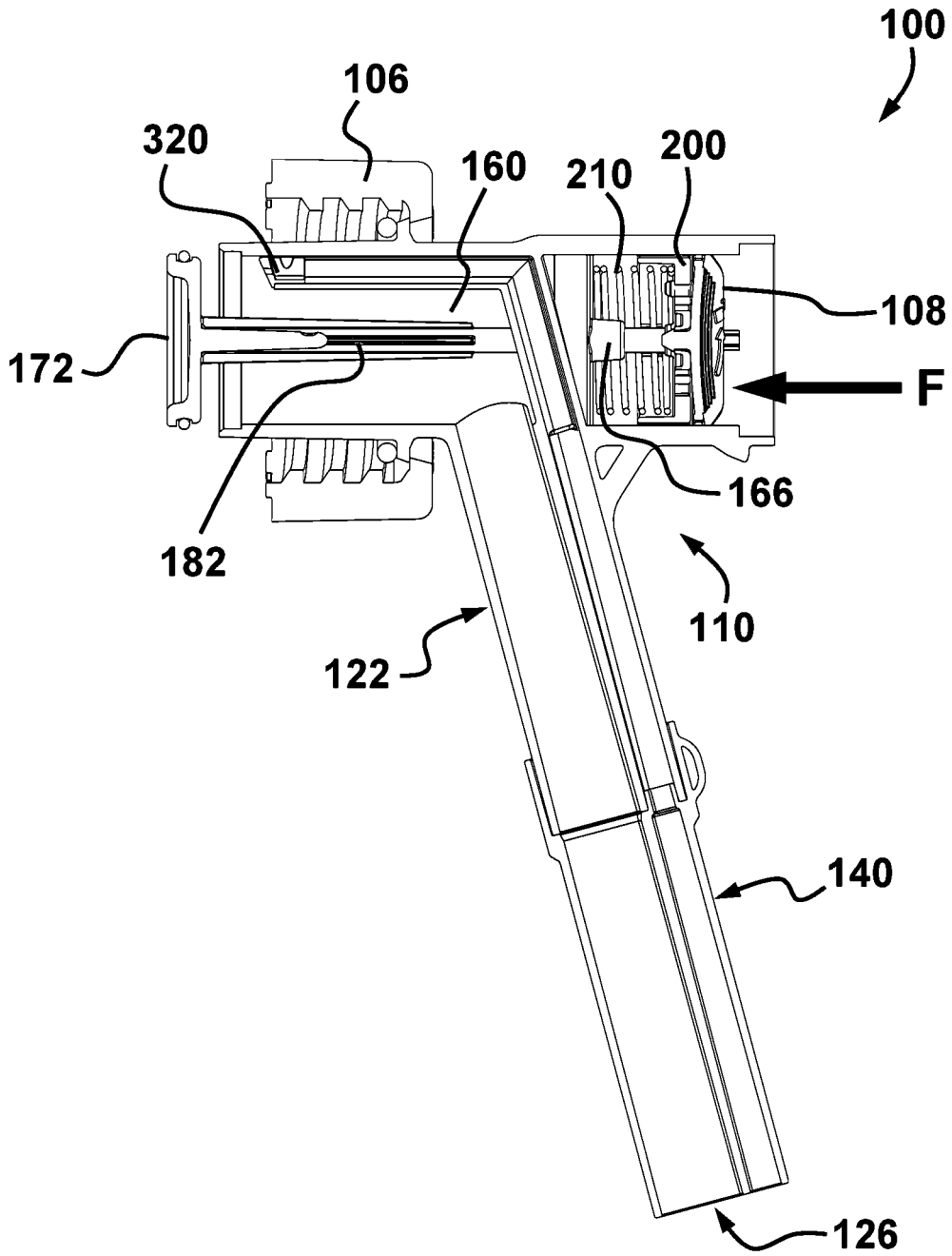
Figure 43:
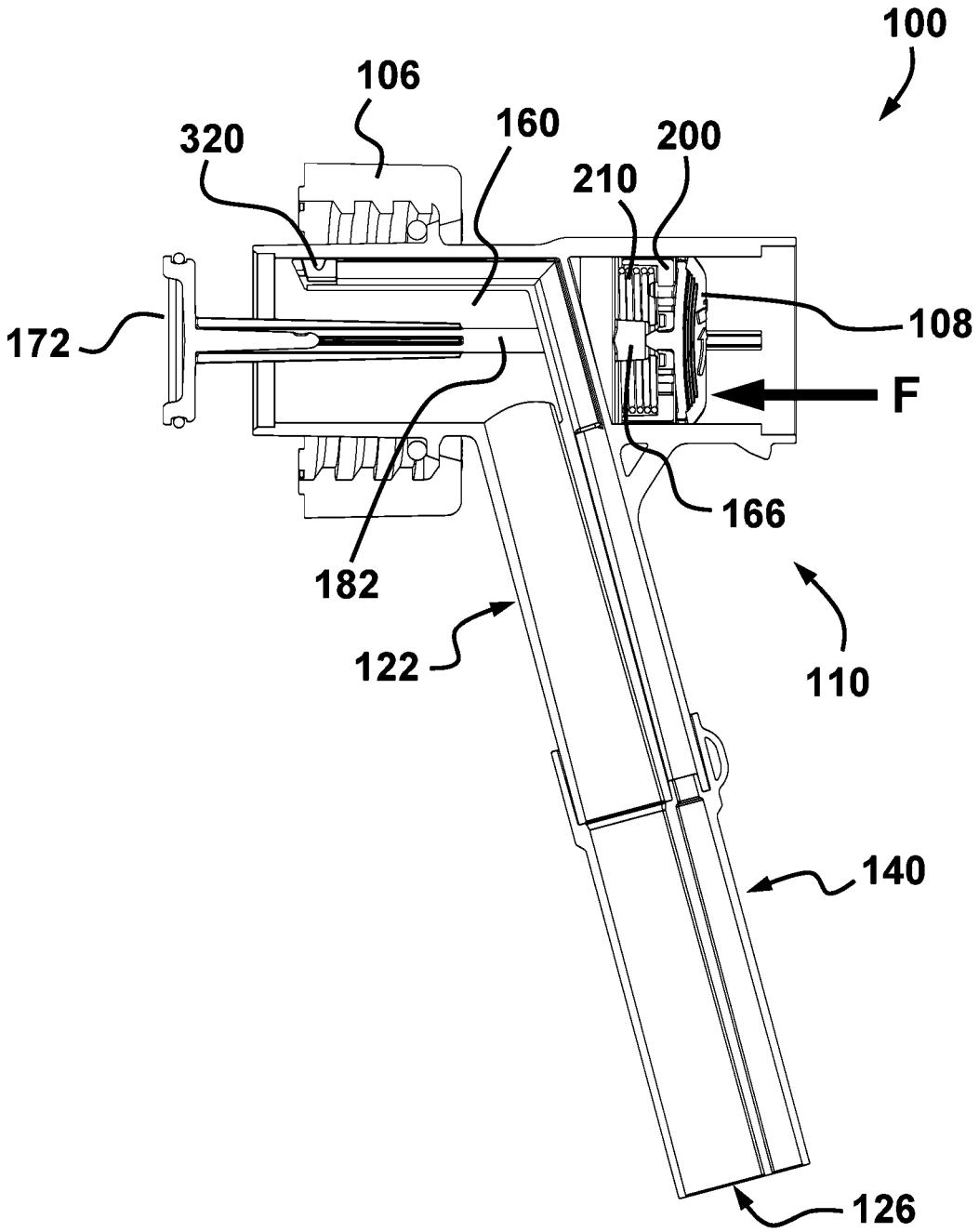

FIGS. 41 to 43 are sequential medial cross section views of the spout 100 shown in FIG. 40.

FIG. 41 shows the spout 100 in the normally closed position but with the CRC device 180 unlocked. A force F can be applied on the push button 108 to open the valve member 172, as shown. The force F can be transmitted in a straight line from the push button 108 to the stems 182 through the sliding member 200. Other configurations and arrangements are possible.

FIG. 42 shows the spout 100 in a partially open position and FIG. 43 shows the spout 100 in the fully opened position. Initially, when the valve member 172 is being opened and the spout base 124 is immersed in the liquid from the container 102, the liquid can start entering the liquid chamber 160 but air can still be present therein. Some of this air can be pushed out of the spout 100 through the spout tip 126 but the rest will go to the top of the liquid chamber 160, thus in the vicinity of the plug 320. This air can exit the spout base 124 mostly at the top of the first open end 120*a*. Air from the air passageway 234 can start flowing out into the liquid at the same time. Other configurations and arrangements are possible.

Overall, the fact that the valve member 172 is located near the rear end of the spout base 124 allows the user to close the valve member 172 after the flow stopped by itself and then move the spout tip 126 upwards without experiencing any spillage, even if the liquid level in the receptacle is near to the limit, since the spout 100 has no residual liquid therein once closed.

The spout 100 can be particularly advantageous for use with small containers because the user may pour liquid from such container using only one hand to hold the container 102 while controlling the spout 100 with the thumb and holding the recipient, or the associated device, with the other hand, for instance when pouring a liquid fuel product in a small mechanical fuel-powered device such as a trimmer or the like. Nevertheless, the spout 100 can be used with larger containers and devices as well.

In use, some air can enter the container 102 through the air circuit 222 during pouring to replace the proportional volume of liquid flowing out of the liquid circuit 220. Air will stop entering the container 102 when the flow of liquid stops. However, interrupting the incoming airflow can significantly reduce and then cut off the liquid flow shortly thereafter because of the increased negative pressure, relative to the ambient air pressure, above the liquid level inside the container 102. The negative pressure built up can start when the spout tip 126 is submerged into the liquid inside the receptacle during the pouring of the liquid from the container 102. This negative pressure is what causes the air to enter but if no more air is admitted, the increased negative pressure can decrease the flow and eventually stop it. Now, since the tip 126 of the spout 100 can be where both the liquid outlet and the air inlet are located, as shown in the illustrated example, the flow of liquid through the spout 100 can automatically decrease and then stop soon after the spout tip 126 is inside the liquid.

As can be appreciated, the spout 100 as proposed herein can have, among other things, one or more the following advantages:

- the valve member 172 can have a robust and durable construction because the two spaced-apart stems 182 can prevent the valve member 172 from pivoting and they can also maintain its alignment;
- the liquid output can be maximized because the flow restrictions are minimized;

the liquid circuit 220 and the air circuit 222 can be opened and closed simultaneously;

the air passageway 234 can always be kept above the liquid passageway 232;

the liquid chamber 160 being wider in cross section than that of the liquid passageway 232, both the liquid chamber 160 and the liquid passageway 232 can be entirely filled with liquid during pouring at the fully opened position and the force of gravity acting on this mass of liquid inside the liquid passageway 232 can improve the suction effect, thereby increasing the flow;

the initial response time can be very fast, and the liquid can start flowing fast almost immediately after opening the valve member 172;

the spout base 124 can be located well inside the container 102 and the valve member 172 can be located directly into the liquid during the pouring;

the flow can be constant when pouring;

the spout 100 can normally be closed when untouched and can automatically close if the user lets go the push button 108;

the flow can automatically be decreased and then stopped when the spout tip 126 is immersed in the liquid of the recipient;

the CRC device 180 can prevent a young child from accidentally opening the spout 100 and spilling the liquid that is inside the container 102;

the CRC device 180 does not necessitate having any external spring;

the CRC device 180 can be operated using a single finger, for instance the thumb or any other finger, and while holding a small container 102 with other fingers of the same hand;

the biasing element 210 of the valve system 170 can be designed with a relatively low spring constant since the CRC device 180 can use another method for preventing young children from opening the spout 100 and the valve member 172 can have a self-closing effect;

the surfaces exposed to the liquid inside the spout 100 can be minimized since, among other things, the spout 100 can be constructed so that no liquid enters the air passageway 234 when pouring and no liquid enters the spout 100 when the valve member 172 is closed;

the number of parts required for manufacturing the spout 100 can be minimized to decrease the manufacturing costs.

The present detailed description and the appended figures are meant to be exemplary only, and a skilled person will recognize that variants can be made in light of a review of the present disclosure without departing from the proposed concept. Among other things, and unless otherwise explicitly specified, none of the parts, elements, characteristics or features, or any combination thereof, should be interpreted as being necessarily essential to the invention simply because of their presence in one or more examples described, shown and/or suggested herein.

LIST OF REFERENCE NUMERALS

100 spout
102 liquid-storage container
104 neck portion (of the container)
106 collar
108 push button
110 main body
120 first member
120*a* first open end (of first member)
120*b* second open end (of first member)
122 second member
124 spout base
126 spout tip
128 protrusion
130 longitudinal axis (of first member)
132 longitudinal axis (of second member)
134 acute angle (between first and second members)
136 medial plane
140 extension conduit
142 socket portion (of the extension conduit)
144 elongated portion (of the extension conduit)
146 hook (on the extension conduit)
150 brace
152 lateral plane
154 outer rim portion
156 outer gasket
160 liquid chamber
162 housing
164 partition
166 opening
170 valve system
172 valve member
174 valve seat
176 valve gasket
180 CRC device
182 valve stem
182*a* proximal part (of stem)
182*b* distal part (of stem)
184 reinforcing rib (on stem)
186 outer circumferential groove
190 connector
192 middle stem
200 sliding member
202 stem socket
210 biasing element (of valve system)
212 longitudinal rib
220 liquid circuit
222 air circuit
230 side opening (of liquid chamber)
232 liquid passageway
234 air passageway
240 first segment (of air passageway)
242 second segment
244 third segment
246 downstream end (of air passageway)
248 intermediary air restriction (inside air passageway)
260 front face (of push button)
262 surface gripping features (on push button)
264 rearwardly projecting rim (of push button)
266 peripheral notch (of push button)
270 mounting pin (of push button)
272 positioning pin (of push button)
274 rear face (of push button)
276 surface (of push button)
280 main portion
282 rearwardly projecting rim
284 peripheral notch
286 mounting hole
290 spring blade
292 slot
294 recessed area (in arc-shaped slot)
296 spring return force
300 air duct (of the extension conduit)
302 projecting portion (of the extension conduit)
304 liquid duct (in the conduit extension)
306 intervening partition

320 plug
322 upstream portion
324 downstream portion
326 inner protuberance
328 outlet opening

What is claimed is:

1. A vented pouring spout for a liquid-storage container, the spout including:

a main body including:

a first member and a second member that extends from a side of the first member, the first member having opposite first and second open ends, the first member including a liquid chamber and a housing that are separated by an internal partition inside the first member;

a liquid circuit passing inside the liquid chamber and then inside a liquid passageway that extends within the second member, the liquid circuit entering the liquid passageway from the liquid chamber through a side opening of the first member;

an air circuit segregated from the liquid circuit and positioned along a top inner side of the main body, the air circuit passing through an air passageway including a first segment, a second segment and a third segment disposed in juxtaposition inside the first member, the first segment being positioned inside the second member, the second segment interconnecting the first and third segments; and a valve system movable between a normally closed position and a fully opened position, the valve system including:

a valve member engaging the first open end of the first member in the normally closed position;

two spaced-apart and parallel stems projecting from an inner side of the valve member into the first member, each stem extending longitudinally inside the first member and being slidably engaged into a corresponding opening made through the partition, each stem passing on a respective lateral side of the second segment of the air passageway;

a push button mounted within the housing and being in an axial force-transmitting engagement with the valve member at least through the stems; and a biasing element located inside the housing to urge the valve member in the normally closed position.

2. The spout as defined in claim 1, wherein the liquid chamber extends longitudinally inside the first member from the first open end to the partition, and the housing extends longitudinally inside the first member from the partition to the second open end.

3. The spout as defined in claim 1, wherein the push button has a front side and a rear side, the rear side being pivotally connected to a sliding member to which a free end of each stem is attached.

4. The spout as defined in claim 3, wherein the spout includes at least one of the following features:

the push button is pivotally connected to the sliding member through a central mounting pin attached in a snap-fit engagement into a central mounting hole of the sliding member;

the biasing element is positioned between the partition and the sliding member.

5. The spout as defined in claim 3, wherein the sliding member includes a plurality of peripheral notches slidingly engaged on corresponding longitudinal ribs provided inside the housing.

6. The spout as defined in claim 5, wherein the longitudinal ribs inside the housing are axisymmetric.

7. The spout as defined in claim 5, wherein the spout includes a child-resistant closure (CRC) device provided inside the first member, the CRC device having a normally locked state where the push button is prevented from moving longitudinally within the housing, and an unlocked state where the push button can be moved longitudinally within the housing to move the valve member.

8. The spout as defined in claim 7, wherein the normally locked and unlocked states of the CRC device are selected by pivoting the push button with reference to the sliding member.

9. The spout as defined in claim 8, wherein the CRC device includes one of the following two features:

a biasing system to urge the push button in a normally locked position, the biasing system of the CRC device generating a torque on the push button beyond what children up to six years old can apply;

at least two spaced-apart positioning pins projecting from a rear face of the push button, the positioning pins extending into corresponding slots provided on the sliding member and being biased towards into a normally locked position using corresponding cantilever spring blades extending within the slots.

10. The spout as defined in claim 1, wherein the spout includes one of the following two features:

the push button includes a concave front face;

the push button includes a concave front face having surface gripping features.

11. The spout as defined in claim 1, wherein the spout includes one of the following two features:

the air passageway is disposed entirely in registry with a geometric medial plane defined by longitudinal axes of the first and second members;

the air passageway is disposed entirely in registry with a geometric medial plane defined by longitudinal axes of the first and second members, the longitudinal axes being positioned at an acute angle relative to one another along the liquid circuit.

12. The spout as defined in claim 1, wherein the spout includes at least one of the following features:

the liquid chamber has a cross section area that is larger than that of the liquid passageway;

the liquid passageway has a substantially constant cross section;

the second member is substantially rectilinear;

the openings through the partition include corresponding sleeves extending longitudinally from the partition.

13. The spout as defined in claim 1, wherein the air passageway has a constricted downstream end located at a top side of the liquid chamber and that is adjacent to the first open end.

14. The spout as defined in claim 13, wherein the spout includes one of the following two features:

the downstream end is constricted by a plug inserted therein;

the downstream end is constricted by a plug inserted therein, the plug having an outlet opening having a cross section area that is smaller than that of the air passageway at the downstream end to create the air restriction.

15. The spout as defined in claim 1, further including an extension conduit removable attachable to a free end of the second member.

16. The spout as defined in claim 15, wherein the spout includes at least one of the following features:

the extension conduit is coaxially disposed with reference to the second member when attached to the second member;

the extension conduit is removably attached to the free end of the second member by an interference fit;

the extension conduit includes a closed hook on an outer surface of the extension conduit.

17. The spout as defined in claim 1, wherein the first open end includes a valve seat, the valve member engaging the first open end of the first member at the valve seat.

18. The spout as defined in claim 17, wherein the spout includes one of the two following features:

the valve seat substantially surrounds entirely the first open end;

the valve seat substantially surrounds entirely the first open end, the valve member including a valve gasket positioned in an outer circumferential groove.

19. The spout as defined in claim 1, wherein the spout includes a child-resistant closure (CRC) device provided inside the first member, the CRC device having a normally locked state where the push button is prevented from moving longitudinally within the housing, and an unlocked state where the push button can be moved longitudinally within the housing to move the valve member.

20. The spout as defined in claim 1, wherein the spout includes at least one of the following features:

the biasing element includes a helical return spring;

the first and second members are made integral with one another and form a monolithic part;

the spout further includes a finger-gripping protrusion provided outside the first member and that is adjacent to the second open end.

* * * * *